US008430031B1

(12) United States Patent
Thorniley et al.

(10) Patent No.: US 8,430,031 B1
(45) Date of Patent: Apr. 30, 2013

(54) IGNITION TRAIN MECHANISM FOR ILLUMINATION FLARE

(75) Inventors: Bruce A. Thorniley, Jackson, TN (US); Michael J. Gray, Selmer, TN (US); Ross W. Guymon, Jackson, TN (US)

(73) Assignee: Kilgore Flares Company, LLC, Toone, TN (US)

( * ) Notice: Subject to any disclaimer, the term of this patent is extended or adjusted under 35 U.S.C. 154(b) by 314 days.

(21) Appl. No.: 12/900,550

(22) Filed: Oct. 8, 2010

Related U.S. Application Data

(60) Provisional application No. 61/292,443, filed on Jan. 5, 2010, provisional application No. 61/368,908, filed on Jul. 29, 2010.

(51) Int. Cl.
*F42B 4/28* (2006.01)

(52) U.S. Cl.
USPC ..... 102/337

(58) Field of Classification Search ..... 102/335–340, 102/354; 89/1.51
See application file for complete search history.

(56) References Cited

U.S. PATENT DOCUMENTS

| | | | | | |
|---|---|---|---|---|---|
| 1,683,940 | A * | 9/1928 | Wiley | ..... | 102/337 |
| 3,425,353 | A * | 2/1969 | Halling | ..... | 102/255 |
| 3,712,232 | A * | 1/1973 | Abel et al. | ..... | 102/531 |
| 3,736,877 | A * | 6/1973 | Roberts et al. | ..... | 102/337 |
| 4,029,014 | A * | 6/1977 | Cunningham | ..... | 102/337 |
| 4,155,306 | A * | 5/1979 | Herold et al. | ..... | 102/336 |
| 7,726,243 | B2 * | 6/2010 | Richards et al. | ..... | 102/254 |

* cited by examiner

*Primary Examiner* — Michael Carone
*Assistant Examiner* — Reginald Tillman, Jr.
(74) *Attorney, Agent, or Firm* — Wyatt, Tarrant & Combs, LLP; H. Roy Berkenstock

(57) ABSTRACT

The present invention relates to an improved apparatus for safely igniting a pyrotechnic device such as a flare which is suspended by a parachute following deployment from an air craft. More specifically, the present invention relates to a two stage ignition train mechanism for use with parachute suspended illumination flares with an in-line firing pin and physical safety mechanism which blocks movement of the firing pin until the parachute is deployed. The present invention also discloses an embodiment of a two stage ignition train mechanism for use with parachute suspended illumination flares with out-of-line firing pin and physical safety mechanism which blocks the firing pin from striking the primer until the parachute is deployed.

9 Claims, 37 Drawing Sheets

IGNITION TRAIN MECHANISM FOR ILLUMINATION FLARE

CROSS-REFERENCE TO RELATED APPLICATIONS

This application relates to U.S. Provisional Patent Application Ser. No. 61/292,443 filed Jan. 5, 2010, entitled Ignition Train Mechanism for Illumination Flare, and to U.S. Provisional Patent Application Ser. No. 61/368,908 filed Jul. 29, 2010, also entitled Ignition Train Mechanism for Illumination Flare and the contents thereof are incorporated fully by reference hereto.

STATEMENT REGARDING FEDERALLY SPONSORED RESEARCH OR DEVELOPMENT

Not Applicable

REFERENCE TO A "MICROFICHE APPENDIX"

Not applicable

BACKGROUND OF THE INVENTION

The present invention relates to an improved apparatus for safely igniting a pyrotechnic device such as a flare which is suspended by a parachute following deployment from an air craft. More specifically, the present invention relates to alternative embodiments of a multiple stage ignition train mechanism for use with parachute suspended illumination flares, one embodiment with an in-line firing pin and the other with an out-of-line firing pin which moves in-line for firing, and a physical safety mechanism which blocks movement of the firing pin until the parachute is deployed.

Pyrotechnic devices such as flares produce brilliant light or intense heat without an explosion. Some flares are used for illumination purposes, for example to provide light on a battle field to better identify potential targets or during a search and rescue mission to assist in locating the objective. Parachute suspended flares provide maximum illumination time over a large area. Many of these illumination flares are deployed from air craft, for example standard U.S. Air Force illumination flares LUU-2 and LUU-19. The LUU-2 emits visible light while the LUU-19 emits infrared light only and is used with night vision goggles. These particular flares are designed to burn approximately five minutes. At an altitude of 1000 feet, the LUU-2 illuminates a circle on the ground of about 500 meters. The flare includes a timer which deploys the parachute and ignites the main candle.

Because illumination flares are designed to emit a large amount of light or energy for a significant length of time, they are often large and heavy. For example, the LUU-2 and LUU-19 are 36 inches long with a 4¾ inch outer diameter and weigh approximately 35 pounds each. It is critical that the flare ignite at the appropriate time—at a pre-set time after ejection from the aircraft—and not before. Accidental ignition prior to ejection or during loading and handling have serious repercussions including damage to equipment and personnel in the ignition area.

It is an objective of the present invention to provide a two-stage ignition train mechanism including a safety mechanism and an ignition mechanism, said safety mechanism incorporating a physical barrier prohibiting forward movement of the firing pin toward the primer and firing mechanism until the parachute is deployed. The ignition mechanism utilizes forces from parachute deployment to initiate the ignition sequence. There is no pre-load on the firing mechanism with the in-line design. It is another objective of the present invention to provide a two stage ignition train mechanism having an ignition mechanism which in a second embodiment is initially out-of-line of the firing axis and is rotated to an in-line position during the descent of the flare housing. The in-line firing pin design creates a more reliable, robust, controllable and consistent ignition sequence, however, by providing a mechanism which brings the initially out-of line firing mechanism in-line during the descent of the flare, added safety to those handling and equipment carrying the flare is achieved. With the inventive out-of-line firing mechanism, there is no pre-load on the firing mechanism. The inventive out-of-line design incorporates the use of shear pins to prevent rotation of the firing mechanism until the predetermined activation force is applied to the mechanism to shear the pin that holds the firing pin housing in place. Further, the end of the lanyard assembly is held in place to block forward motion of the firing pin until a second shear pin is sheared by a predetermined force, sufficient to cock the firing pin and bring the firing mechanism in-line with the primer compartment hole is reached. This is achieved safely with the post-launch rotation to the in-line firing position, achieving a "delayed" alignment with the firing pin and primer to the pellet cavity through the added physical barrier of the safety mechanism. Another objective of the present invention is to design a two stage ignition train system which, when dropped from forty feet, will not trigger the ignition sequence by inertia or incidental deployment of the timer or ignition train assembly.

BRIEF SUMMARY OF THE INVENTION

The present invention relates to an improved apparatus for safely igniting a pyrotechnic device such as a flare which is suspended by a parachute following deployment from an air craft. More specifically, the present invention relates to a two stage ignition train mechanism for use with parachute suspended illumination flares with an out-of-line firing pin and physical safety mechanism which blocks movement of the firing pin until the parachute is deployed. With the firing pin initially off-set from the firing axis, the primer assembly is displaced from the pellets and significantly reduces the possibility of an electro-static discharge activation of the primer from igniting the pellets. The present invention also relates to a two stage ignition train mechanism for use with parachute suspended illumination flares with an in-line firing pin and physical safety mechanism which blocks movement of the firing pin until the parachute is deployed.

DESCRIPTION OF THE DRAWINGS

FIGS. 1 though 9 illustrate the in-line firing mechanism of the present invention and FIGS. 10 through 21 illustrate the out-of-line firing mechanism of the present invention.

FIG. 1 is a cross sectional view of the housing for a parachute suspended illumination flare.

FIGS. 16 through 21 are top views of a second embodiment of the ignition train mechanism of the present invention showing the sequence of motion of the firing mechanism from initial movement at the unarmed, out-of-line position through ignition of the primer and pellets at the firing, in-line position.

DETAILED DESCRIPTION OF THE INVENTION

Figure 1:
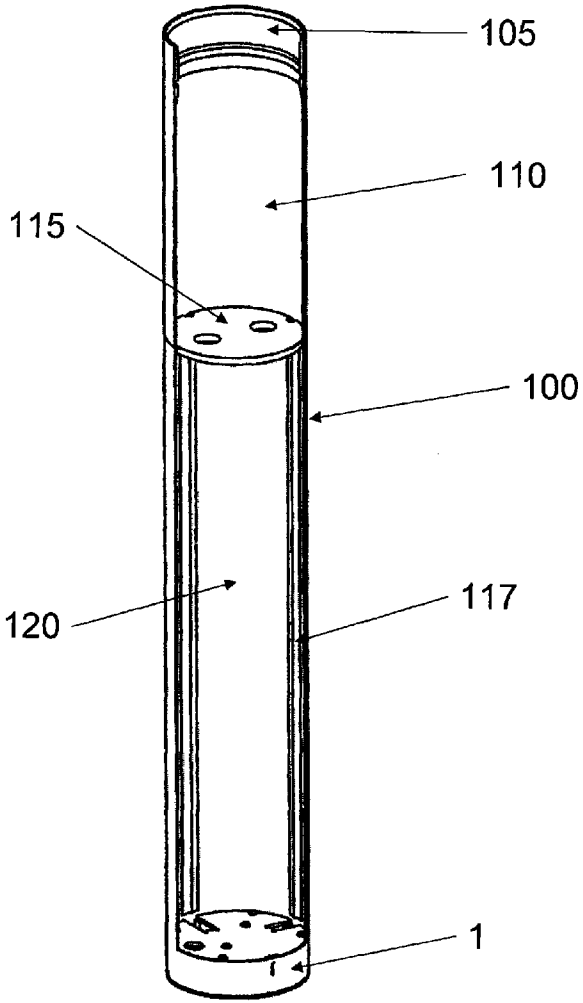

Referring now to FIGS. 1 through 9, the ignition train housing 1 is positioned at the aft or back end of the interior of the illumination flare housing 100. A timer (not shown) is positioned in the timer compartment 105 at the forward or front end of the illumination flare housing 100. The timer has a pre-set mechanism which controls the ejection of the parachute from the illumination flare housing 100. The parachute is positioned below the timer in the parachute compartment 110 of the illumination flare housing 100. The bulkhead 115 is positioned below the parachute compartment 110 and separates the parachute compartment 110 and the main candle compartment 120. The bulkhead has two riser holes 114 drilled through its surface. There are two cables called risers (not shown) which connect the parachute to the bulkhead. One end of each riser is connected to the parachute and the other end of each riser is attached to one of the riser holes 114 with a fastener such as a screw or bolt assembly.

Figure 2:
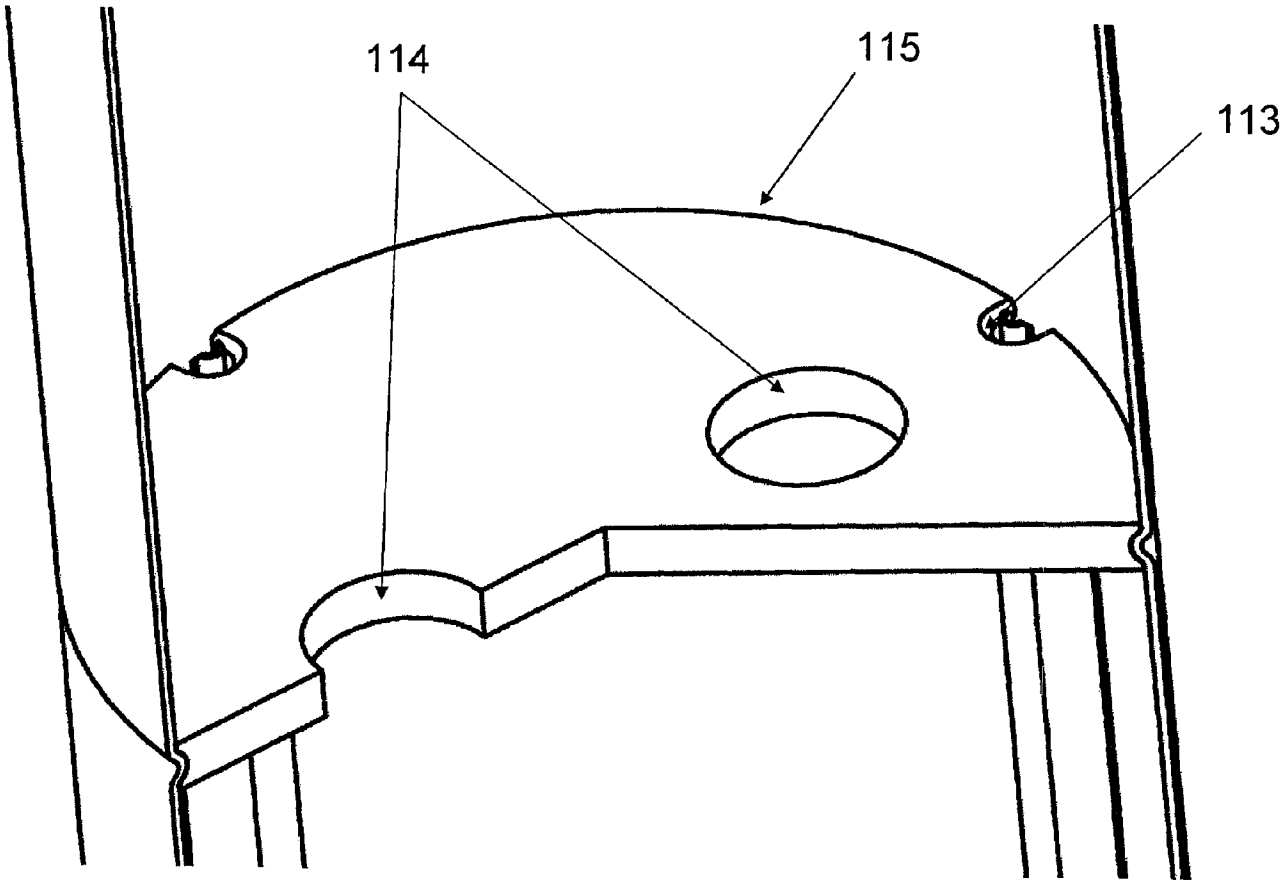
FIG. 2 is a cross sectional view of the front or forward end of the housing for a parachute suspended illumination flare showing the bulkhead.

Referring still to FIG. 1, the main candle compartment 120 contains the flare composition (not shown). A first raceway channel 116 (not shown) and a second raceway channel 117 extend longitudinally down the side of the main candle compartment 120 between the bulkhead 115 and the ignition train housing 1. Referring now to FIG. 2, the bulkhead has a first and a second ignition train cable hole 113 (only one shown) positioned adjacent to each raceway channel 116, 117 (shown in FIG. 3).

Figure 3:
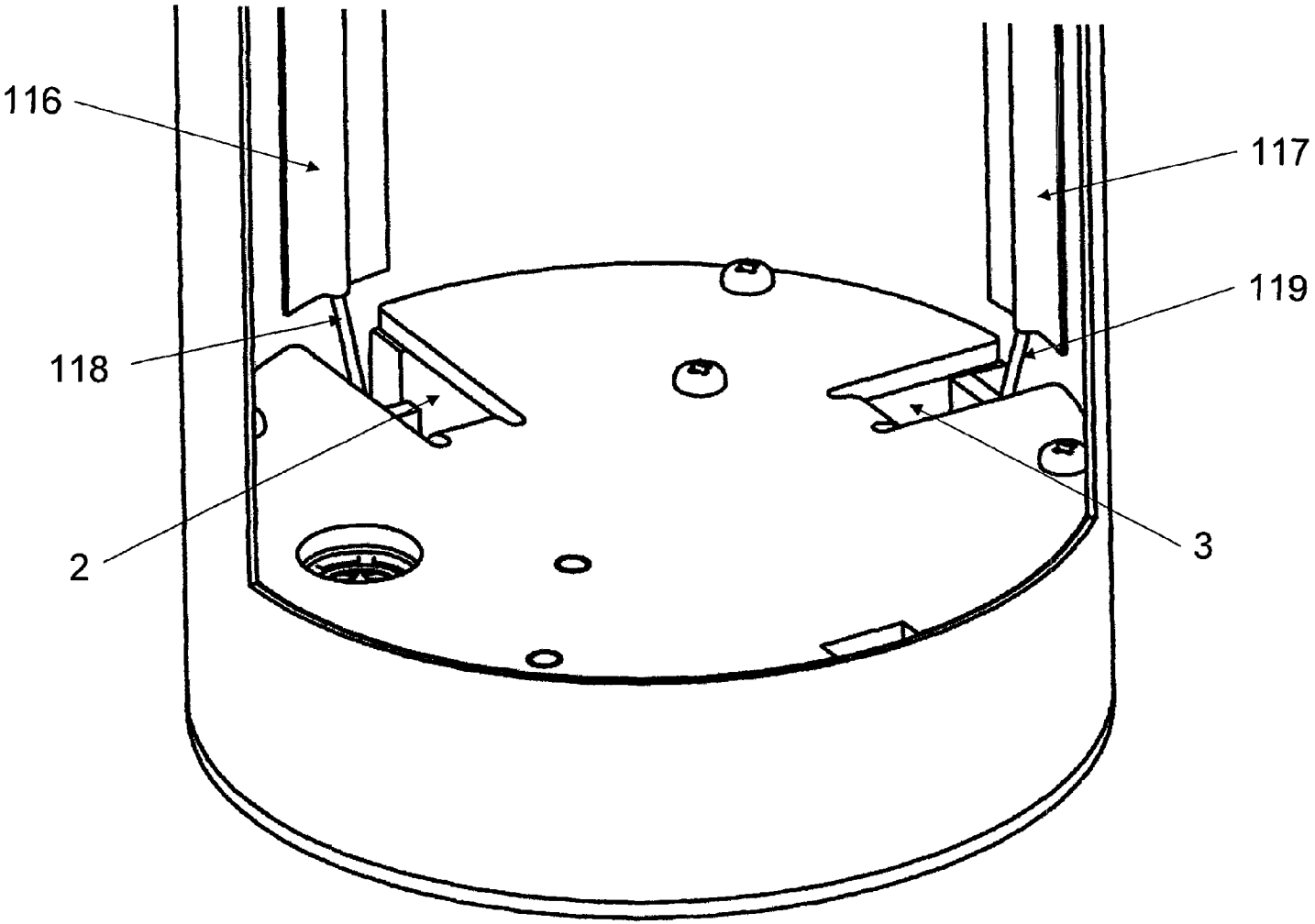
FIG. 3 is a cross sectional view of the back or aft end of the housing for a parachute suspended illumination flare.

Referring now to FIG. 3, a safety cable 118 is attached to a first riser (not shown) and extends through the first ignition train cable hole 112 (not shown) and longitudinally along the side of the illumination flare housing from the bulkhead to the ignition train housing 1 via the interior of the first raceway channel 116. The safety cable 118 enters the ignition train housing 1 via the safety mechanism opening 2 in the ignition train housing 1. Referring now to FIG. 3, an ignition cable 119 is attached to the first riser (not shown) and extends through the second ignition train cable hole 113 (FIG. 2) and longitudinally along the side of the illumination flare housing from the bulkhead to the ignition train housing 1 via the interior of the second raceway channel 117. The ignition cable 119 enters the ignition train housing 1 via the ignition mechanism opening 3 in the ignition train housing 1. When the parachute is ejected from the illumination flare housing 100, the first and second risers extend to their full length. The tension from the fully extended riser puts tension on the safety cable 118 and ignition cable 119 which are attached to one of the risers.

Figure 4A:
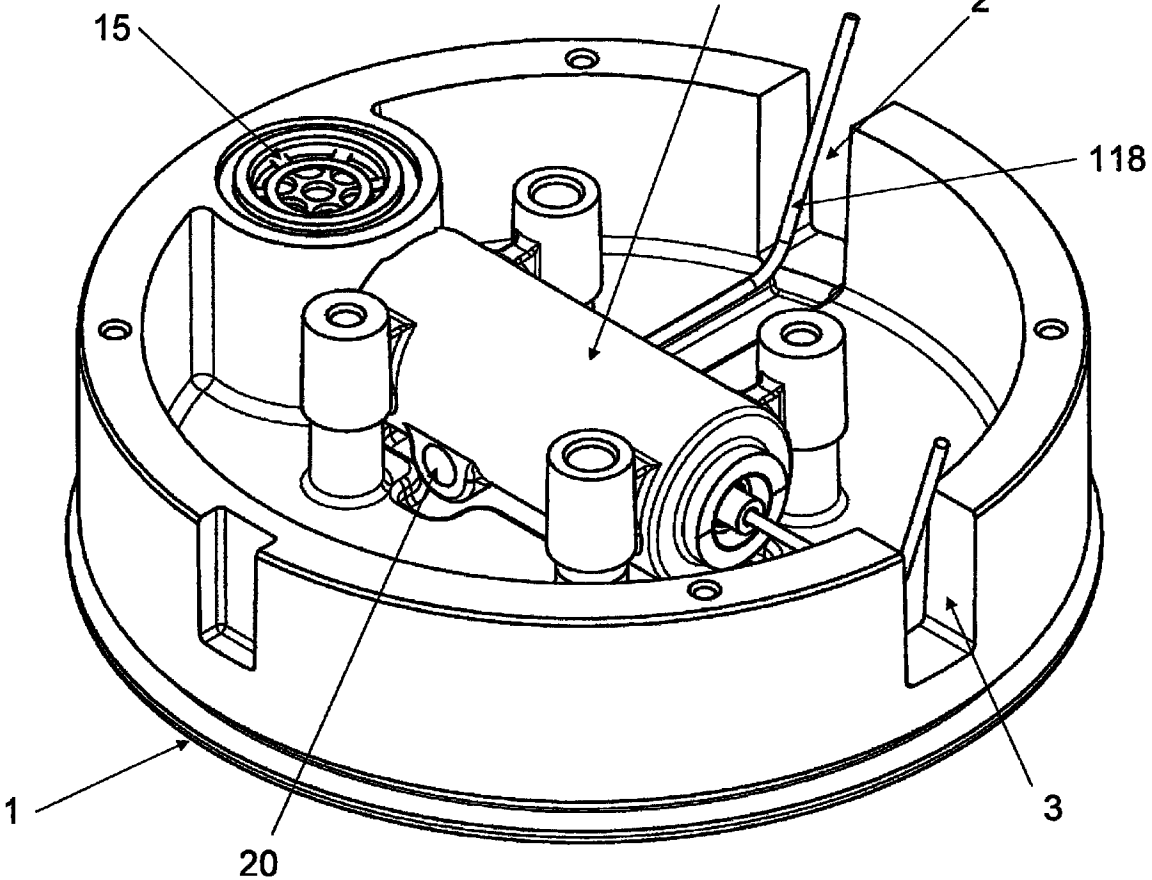
FIG. 4*a* is a prospective view of the ignition train housing including one embodiment of the two stage ignition mechanism of the present invention.
Figure 4B:
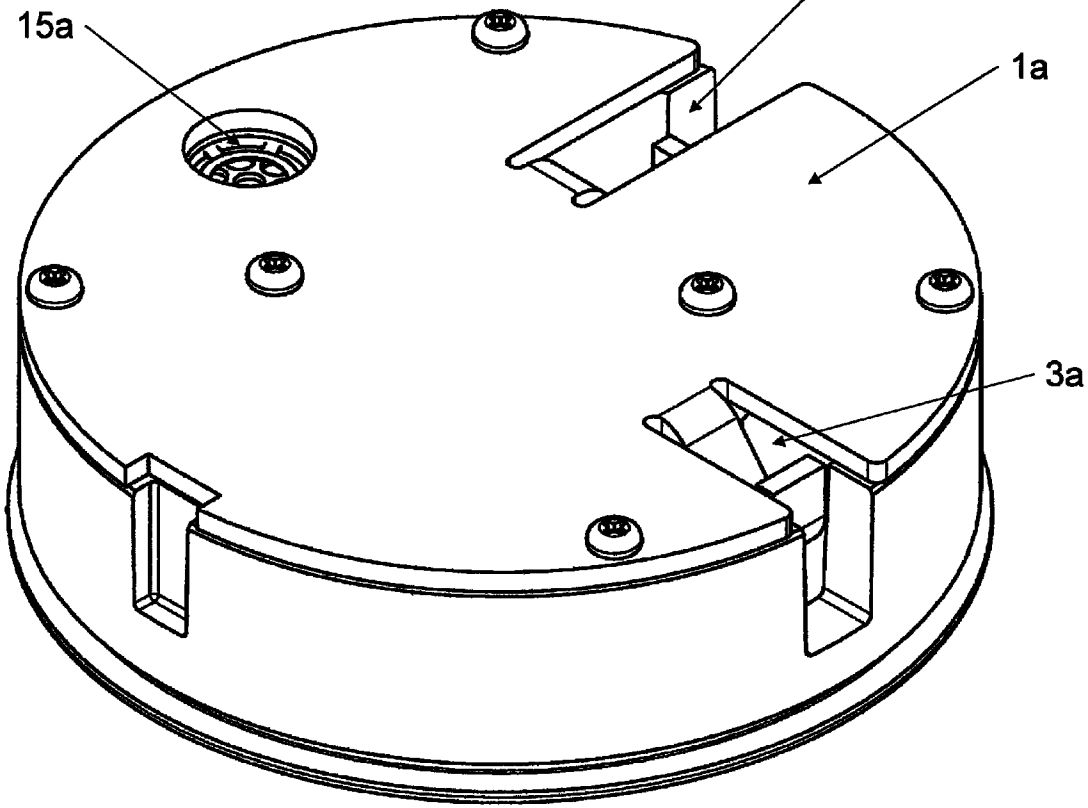
FIG. 4*b* is a prospective view of the ignition train housing including one embodiment of the two stage ignition mechanism of the present invention including the cover for the ignition train housing.

Referring now to FIG. 4*a*, the ignition mechanism housing 5 is affixed to the base of the ignition train housing 1. A first end of said ignition mechanism housing 5 is aligned with the ignition cable opening 3 such that said ignition cable 119 enters said first end of said ignition mechanism housing 5. A second end of said ignition mechanism housing 5 is aligned with said ignition primer compartment 10 (FIG. 8) and an ignition canister 15 such as a Peket canister. Referring now to FIG. 4*b*, a cover 1*a* is affixed to the top of the ignition train housing 1. The cover 1*a* is adjacent to the main candle compartment 120 of the illumination flare housing 100 (FIG. 1). The cover 1*a* has at least three openings, a first opening 3*a* aligned with the safety cable opening 3, a second opening 2*a* aligned with the ignition cable opening 2, and a third opening 15*a* aligned with said ignition canister 15. The ignition canister 15 has an open top which is affixed to the cover 1*a* such that the heat of combustion may pass through to the main candle compartment 120 thereby igniting the main candle of the illumination flare via the ignition sequence described below.

Figure 5A:
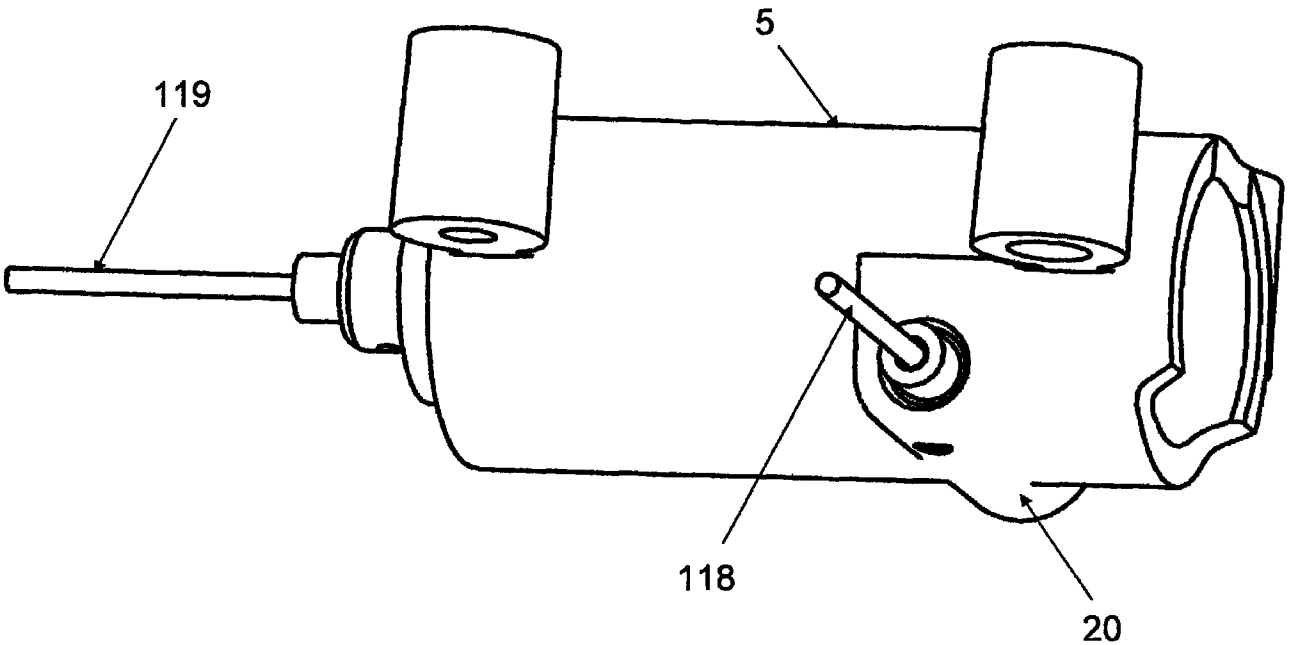
FIG. 5*a* is a side view of the ignition mechanism housing and safety mechanism housing of the two stage ignition mechanism of one embodiment of the present invention.
Figure 5B:
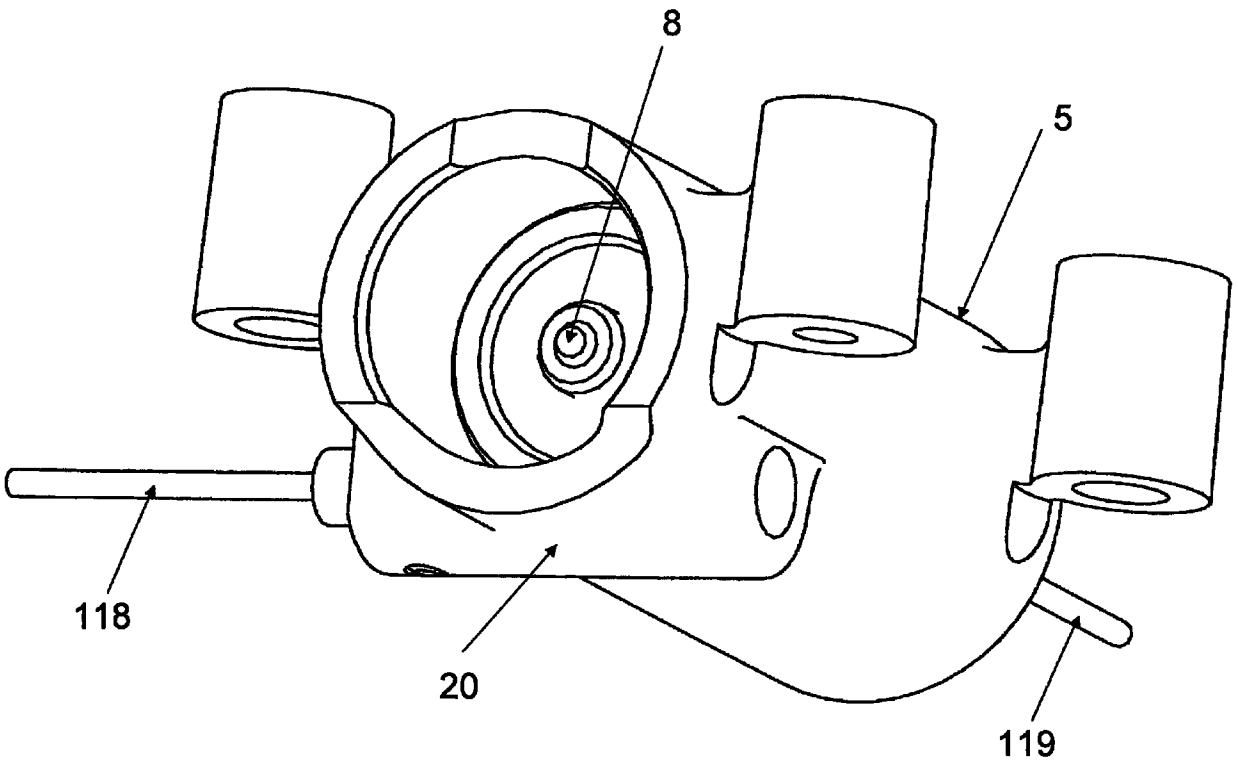
FIG. 5*b* is another side view of the ignition mechanism housing and safety mechanism housing of the two stage ignition mechanism of one embodiment of the present invention.
Figure 6:
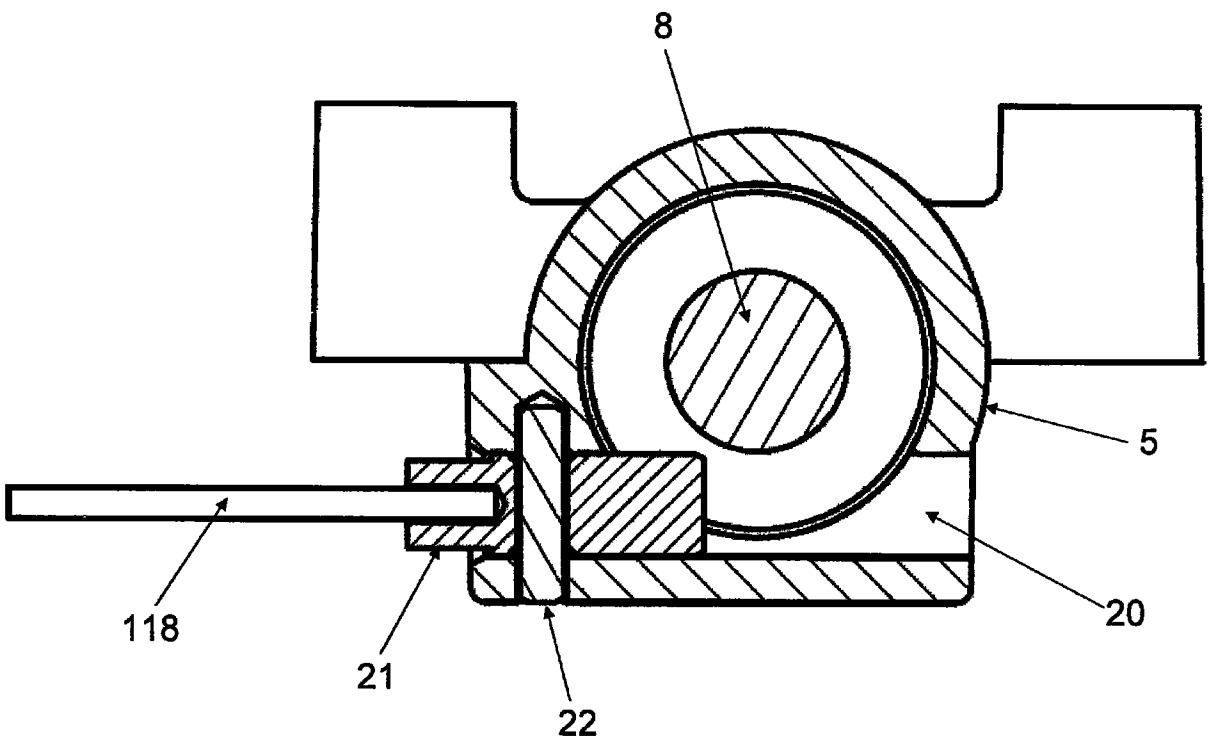
FIG. 6 is a cross sectional view of the ignition mechanism housing and safety mechanism housing of the one embodiment of the two stage ignition mechanism of the present invention.
Figure 7:
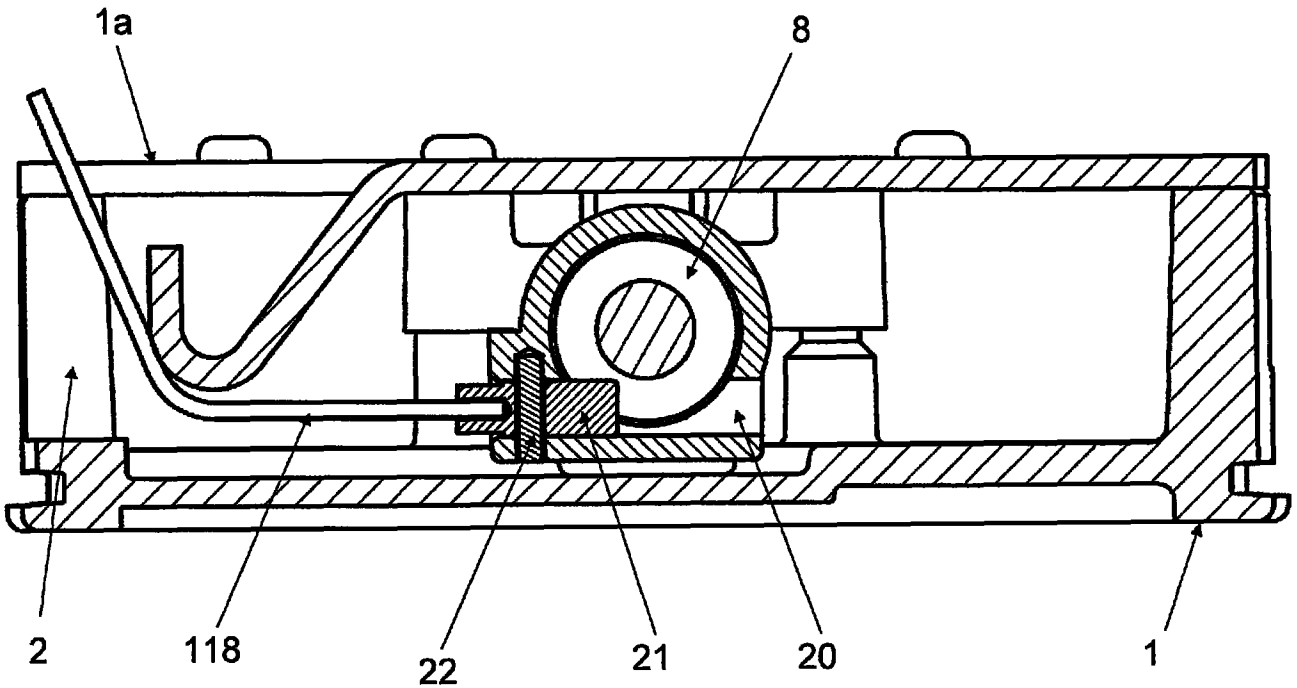
FIG. 7 is a cross sectional view of the ignition train housing, including a cross sectional view of the safety mechanism housing, of one embodiment of the two stage ignition mechanism of the present invention.
Figure 8:
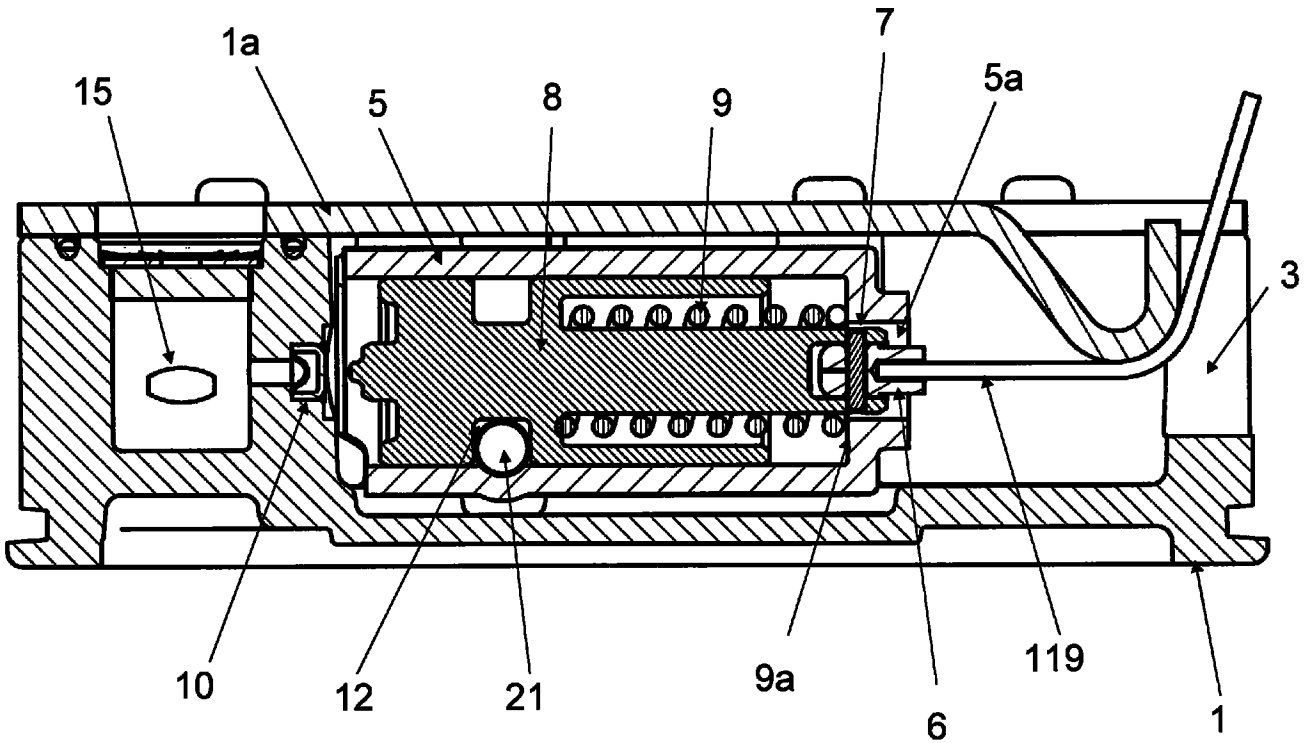
FIG. 8 is a cross sectional view of the ignition train housing, including a cross sectional view of the ignition mechanism housing, of one embodiment of the two stage ignition mechanism of the present invention.

As shown in FIGS. 5*a* and 5*b*, safety mechanism housing 20 intersects the ignition mechanism housing 5. A first end of said safety mechanism housing 20 is aligned with the safety cable opening 2 (FIG. 4*a*) such that said safety cable 118 enters said first end of said safety mechanism housing 20. As shown in FIG. 8, said safety mechanism housing is hollow and passes through an opening 12 in a firing pin 8. Referring now to FIGS. 6 and 7, a safety fitting 21 is located inside said safety mechanism housing 20. Said safety fitting 21 is secured to said safety mechanism housing 20 with a safety shear pin 22. Said safety shear pin 22 passes through a hole in said housing 20 and in said safety fitting 21. A first end of said safety fitting 21 is engaged with the opening 12 in the firing pin 8 prohibiting axial movement of said firing pin 8. The safety cable 118 is attached to a second end of said safety fitting 21. The safety shear pin 22 is designed to break at a pre-set force. When the parachute is deployed from the illumination flare housing 100 and the risers are fully extended thereby putting tension on the safety cable 118, the safety fitting 21, and the shear pin 22. Once the shear pin 22 experiences the pre-set amount of force, the shear pin 22 breaks and the safety fitting 21 becomes disengaged with the opening 12 in the firing pin 8 thereby allowing axial movement of the firing pin 8.

Figure 9:
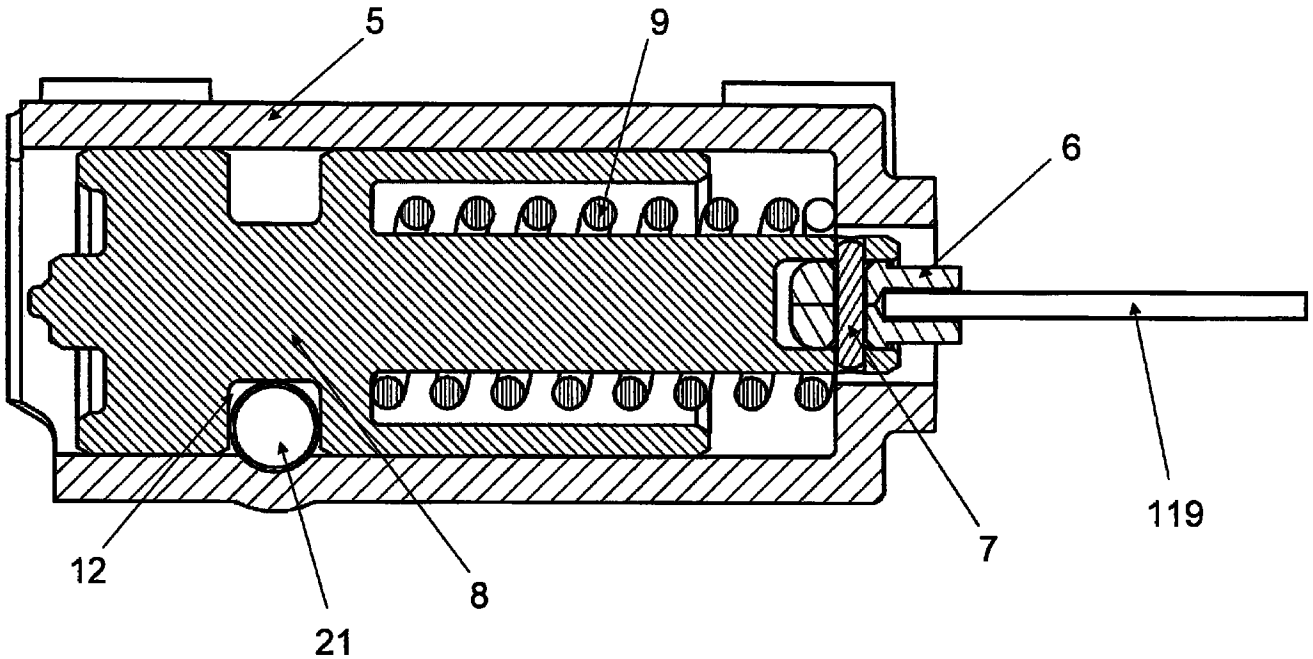
FIG. 9 is a cross sectional view of the ignition mechanism housing of one embodiment of the two stage ignition mechanism of the present invention.

Referring now to FIGS. 8 and 9, an ignition fitting 6 is located inside the opening 5*a* of said ignition mechanism housing 5 at said first end of said housing 5. Said ignition fitting 6 is secured to a first end of a firing pin 8 with an ignition shear pin 7. Said ignition shear pin 7 passes through a hole in said firing pin 8 and in said ignition fitting 6 such that when the fitting 6 moves toward the opening 5*a*, the firing pin also moves toward the opening 5*a*. The ignition shear pin 7 is designed to break at a pre-set force. The ignition cable 119 is attached to a first end of said ignition fitting 6. The firing pin 8 is located inside and axially aligned with said ignition mechanism housing 5. The firing pin 8 extends longitudinally through said ignition mechanism housing 5 to the second end of said ignition mechanism housing 5. Said second end of said ignition mechanism housing 5 has an opening which is adjacent to said ignition primer compartment 10. Said primer compartment 10 is attached to said ignition canister 15. Said second end of said firing pin 8 is aligned with said opening in said second end of said ignition mechanism housing 5 and has a shape such that it is capable of engaging with said ignition primer (not shown). Thus said firing pin 8 is in-line with said ignition primer.

A spring 9 surrounds a portion of the firing pin 8 as shown in FIGS. 8 and 9. The ignition mechanism housing 5 has a stop 9*a* adjacent the opening 5*a*. The stop 9*a* limits the movement of the firing pin 8 in the direction of the opening 5*a* thereby compressing the spring 9 upon such movement.

When the parachute is deployed from the illumination flare housing 100 and the risers are fully extended thereby putting tension on the safety cable 118, the safety fitting 21, and the shear pin 22. Once the shear pin 22 experiences the pre-set amount of force, the shear pin 22 will break and the safety fitting 21 will become disengaged with the opening 12 in the firing pin 8 thereby allowing axial movement of the firing pin 8. The fully extended riser also puts tension on the ignition cable 119, the ignition fitting, 6, the ignition shear pin 7, the spring 9, and the firing pin 8. Additionally, the movement of the firing pin 8 towards the first opening 5*a* of the housing 5 compresses the spring 9. When the tension on the ignition shear pin 7 exceeds the pre-set force, the ignition shear pin 7 breaks and the firing pin 8 and ignition fitting 6 become separated. The ignition fitting 6 continues its backwards movement away from the primer compartment 10. The firing pin 8, due to the energy stored in the spring 9, is propelled forward towards the primer compartment 10 and strikes the primer contained in the primer compartment 10 creating a spark.

The ignition primer compartment 10 contains an ignition primer to create a spark when struck by the firing pin 8. The ignition primer can be any ignition primer composition commonly used with pyrotechnic flares, for example CCI Inc. No. 200 Rifle Primer. The ignition primer compartment is connected to the ignition canister 15 such that the heat from the primer compartment 10 is transferred to ignition canister 15. The bottom portion of the ignition canister 15 contains ignition pellets which are ignited by the heat from the ignition primer compartment 10. The ignition pellets can be made of any composition of pyrotechnic material commonly used with pyrotechnic flares. For example $BKNO_3$ pellets which are primarily made of potassium nitrate. The top of the ignition canister 15 is open and connected to the main candle compartment 120 via opening 15*a*. The lower surface of the main candle compartment 120 contains an ignition compound which is ignited by the heat from the ignition pellets. The heat from the ignition canister 15 is transferred to the main candle compartment 120 and ignites the ignition compound. The ignition compound can be made of any composition of pyrotechnic material commonly used with pyrotechnic flares. The remainder of the main candle compartment contains the main candle flare composition. The heat from the ignition compound ignites the main candle composition of the flare. The main candle composition can be made of any composition of pyrotechnic material commonly used with pyrotechnic flares.

Referring now to FIGS. 10 through 21, a second embodiment of the ignition train mechanism is disclosed. As shown in FIG. 10*c*, the ignition train housing 201 is positioned at the aft or back end of the interior of the illumination flare housing 100. A timer (not shown) is positioned in the timer compartment 105 at the forward or front end of the illumination flare housing 100. The timer has a pre-set mechanism which controls the ejection of the parachute from the illumination flare housing 100. The parachute is positioned below the timer in the parachute compartment 110 of the illumination flare housing 100. The bulkhead 115 is positioned below the parachute compartment 110 and separates the parachute compartment 110 and the main candle compartment 120. The bulkhead has two riser holes 114 drilled through its surface. There are two cables called risers (not shown) which connect the parachute to the bulkhead. One end of each riser is connected to the parachute and the other end of each riser is attached to one of the riser holes 114 with a fastener such as a screw or bolt assembly.

Figure 10A:
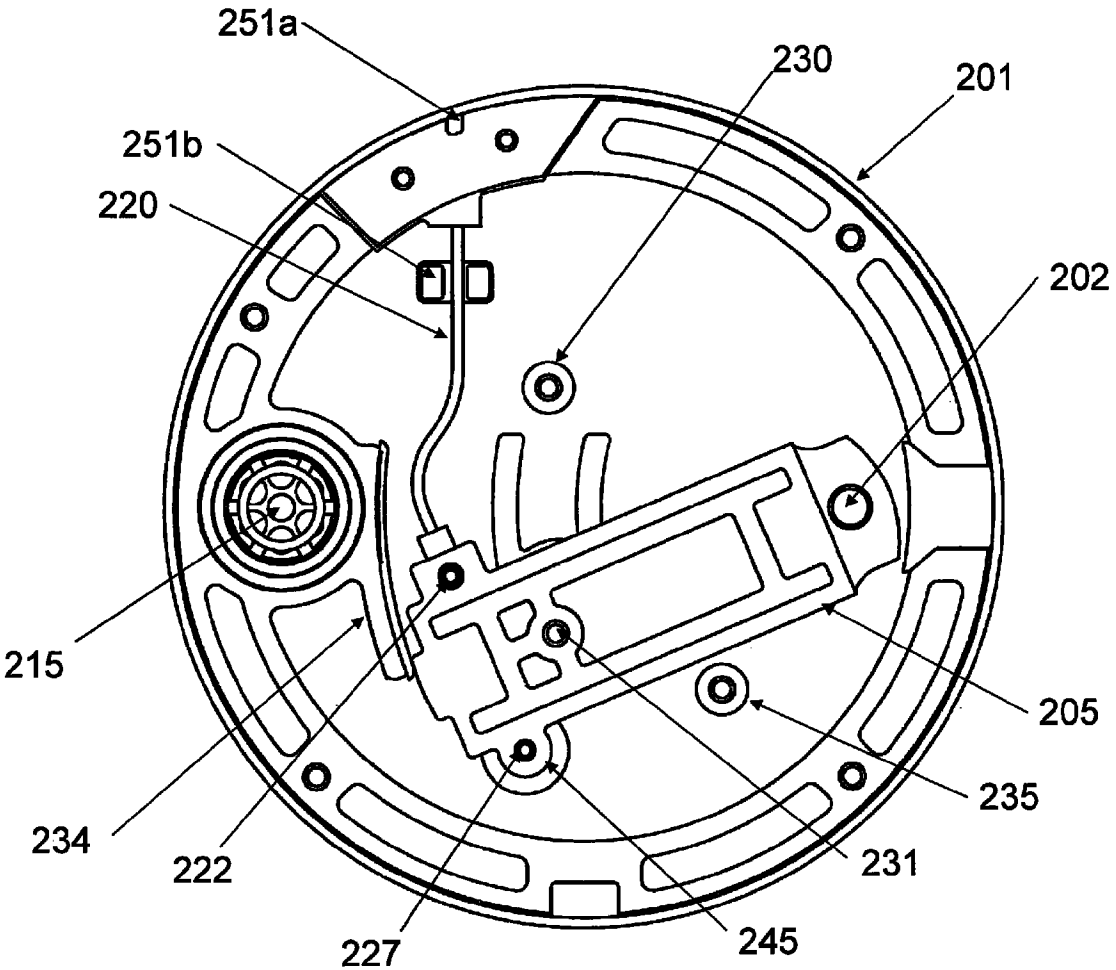
FIG. 10*a* is a prospective view of the ignition train housing of a second embodiment of the two stage ignition mechanism of the present invention.
Figure 10B:
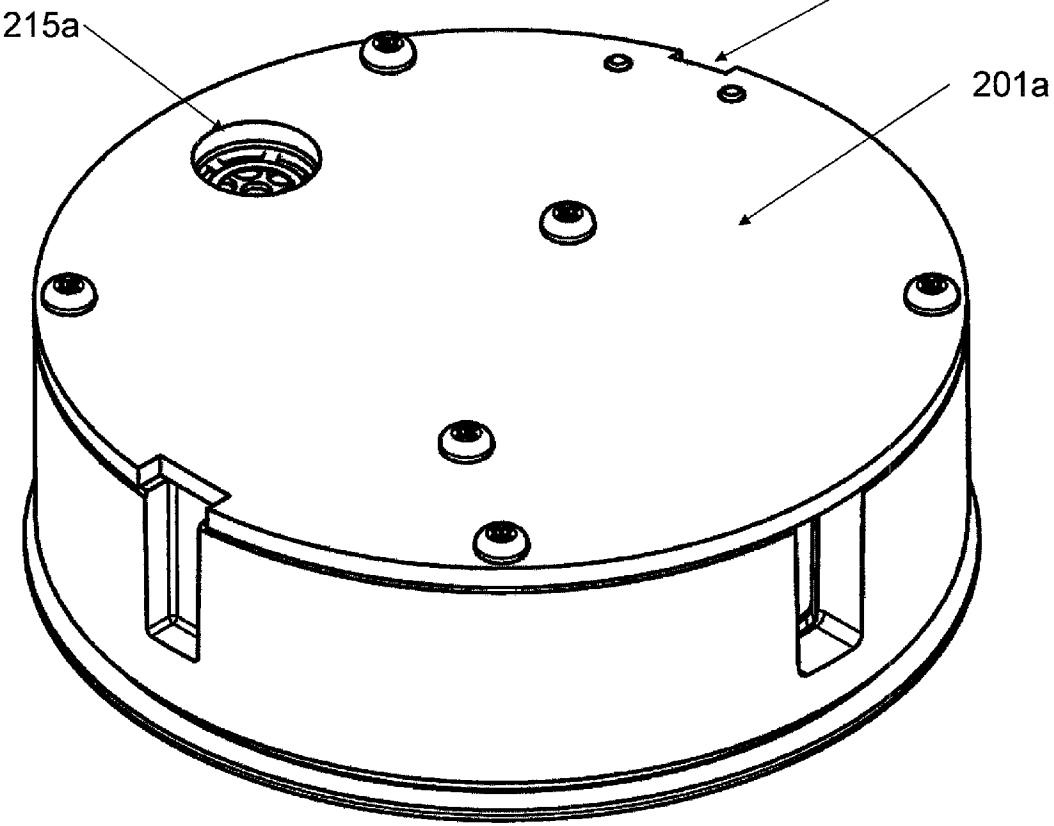
FIG. 10*b* is a prospective view of the ignition train housing of a second embodiment of the two stage ignition mechanism of the present invention including the cover for the ignition train housing.
Figure 10C:
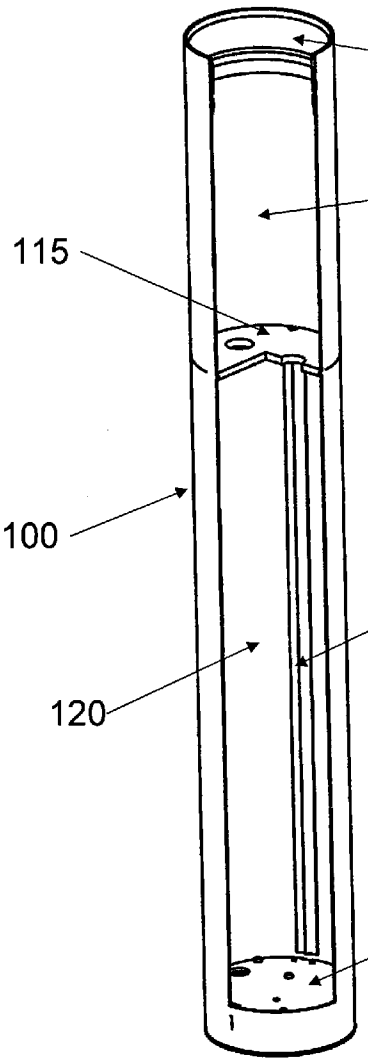
FIG. 10*c* is a cross sectional view of the housing for a parachute suspended illumination flare showing details of the bulkhead, raceway channel and main candle compartment.
Figure 10D:
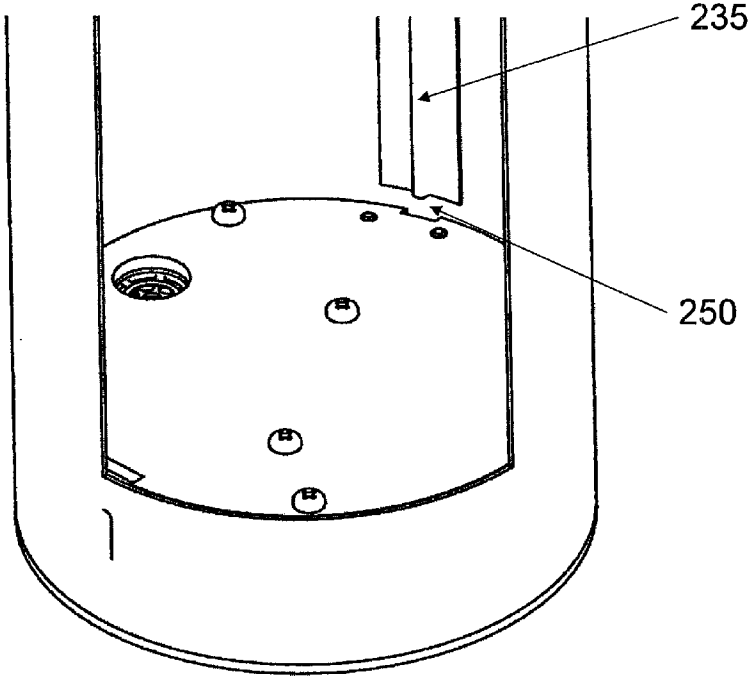
FIG. 10*d* is a cross sectional view of the back or aft end of the housing for a parachute suspended illumination flare.
Figure 10E:
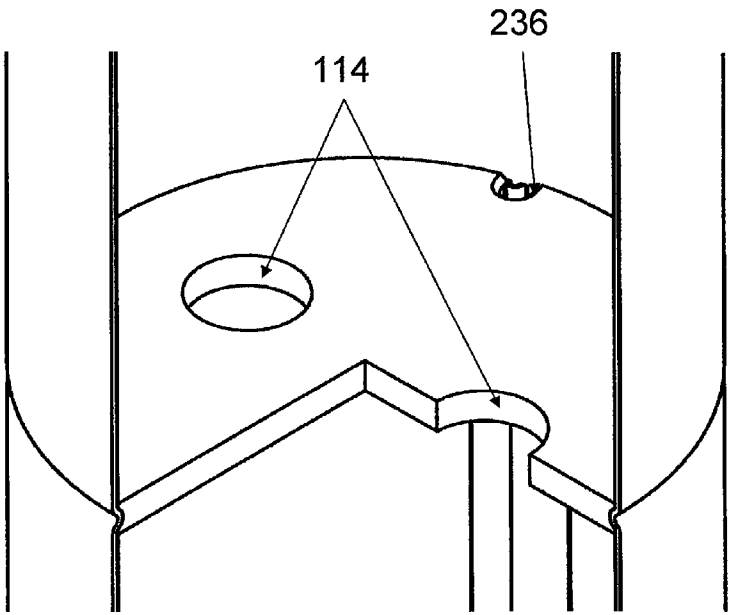
FIG. 10*e* is a cross sectional view of the front or forward end of the housing for a parachute suspended illumination flare showing the bulkhead and raceway channel.
Figure 12A:
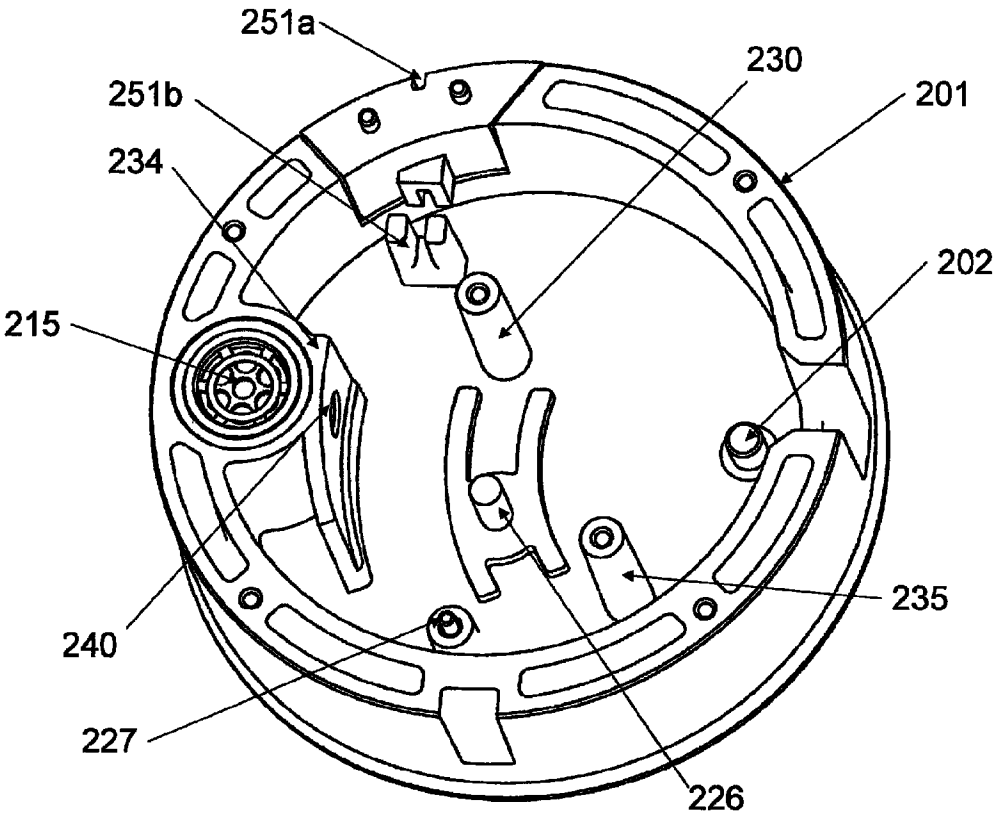
FIGS. 12*a* and 12*b* are prospective views of a second embodiment of the ignition train mechanism of the present invention showing the inside of the housing with the firing pin mechanism removed.

Referring still to FIG. 10*c*, the main candle compartment 120 contains the flare composition (not shown). A raceway channel 235 extends longitudinally down the side of the main candle compartment 120 between the bulkhead 115 and the ignition train housing 201. Referring now to FIG. 10*e*, the bulkhead has an ignition train cable hole 236 positioned adjacent to the raceway channel 235. A lanyard cable 220 (not shown) is attached to a riser (not shown) and extends through the lanyard cable hole 236 and longitudinally along the side of the illumination flare housing from the bulkhead to the ignition train housing 201 via the interior of the raceway channel 235. The lanyard cable 220 traverses the ignition train housing cover 201*a* through a hole 250 in the cover 201*a* (FIG. 10*b*) and enters the ignition train housing 201 through the lanyard cable guide 251*a* (FIG. 12*a*). The lanyard cable guides 251*a* and 251*b* position the cable such that it extends through the ignition train housing 201 to the firing mechanism housing 205 where it is engaged with the housing 205 (See FIGS. 14*a, b*, and *c*). When the parachute is ejected from the illumination flare housing 100, the risers extend to their full length. The tension from the fully extended riser puts tension on the lanyard cable 220 which is attached to one of the risers.

Figure 14A:
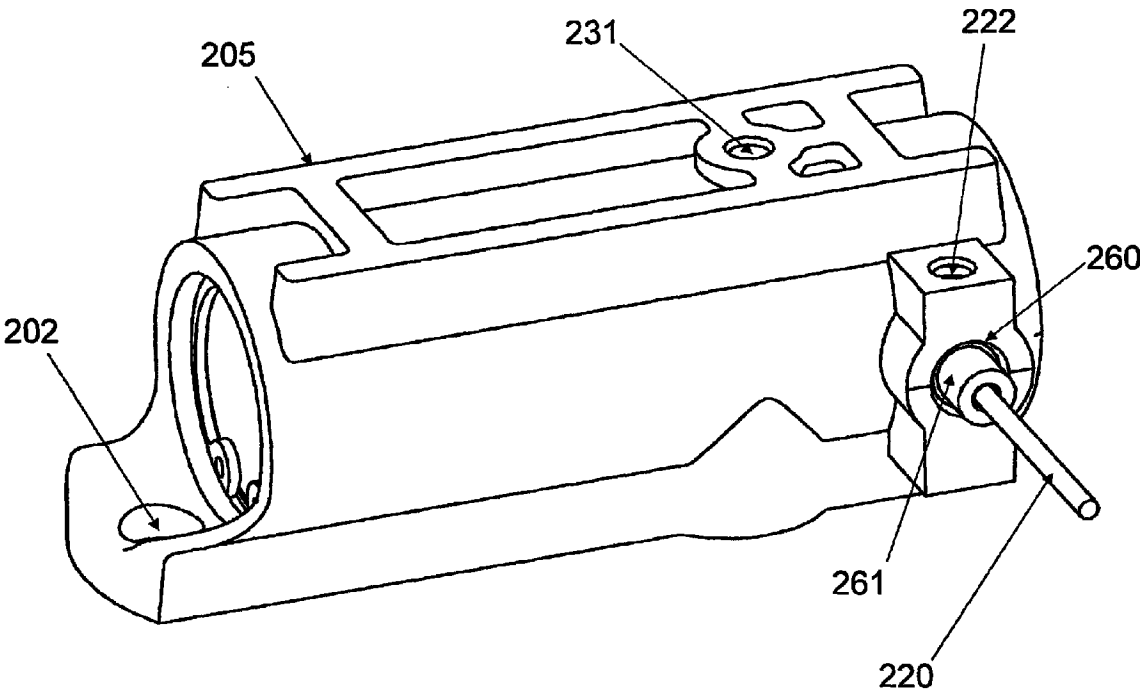
FIG. 14*a* is a side view of the firing mechanism housing of a second embodiment of the ignition train mechanism of the present invention.
Figure 14B:
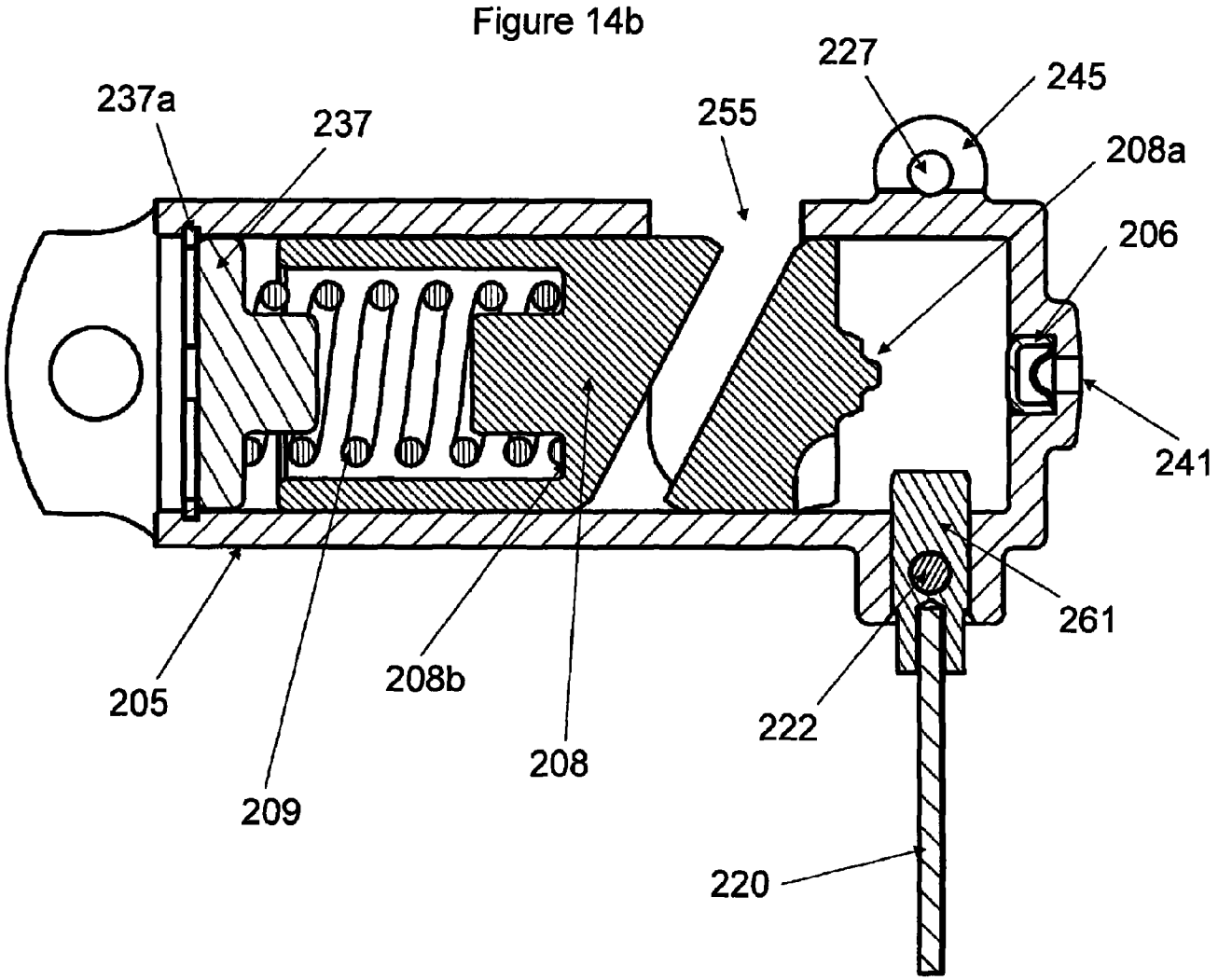
FIG. 14*b* is a cross sectional top view of the firing mechanism housing of a second embodiment of the ignition train mechanism of the present invention.
Figure 14C:
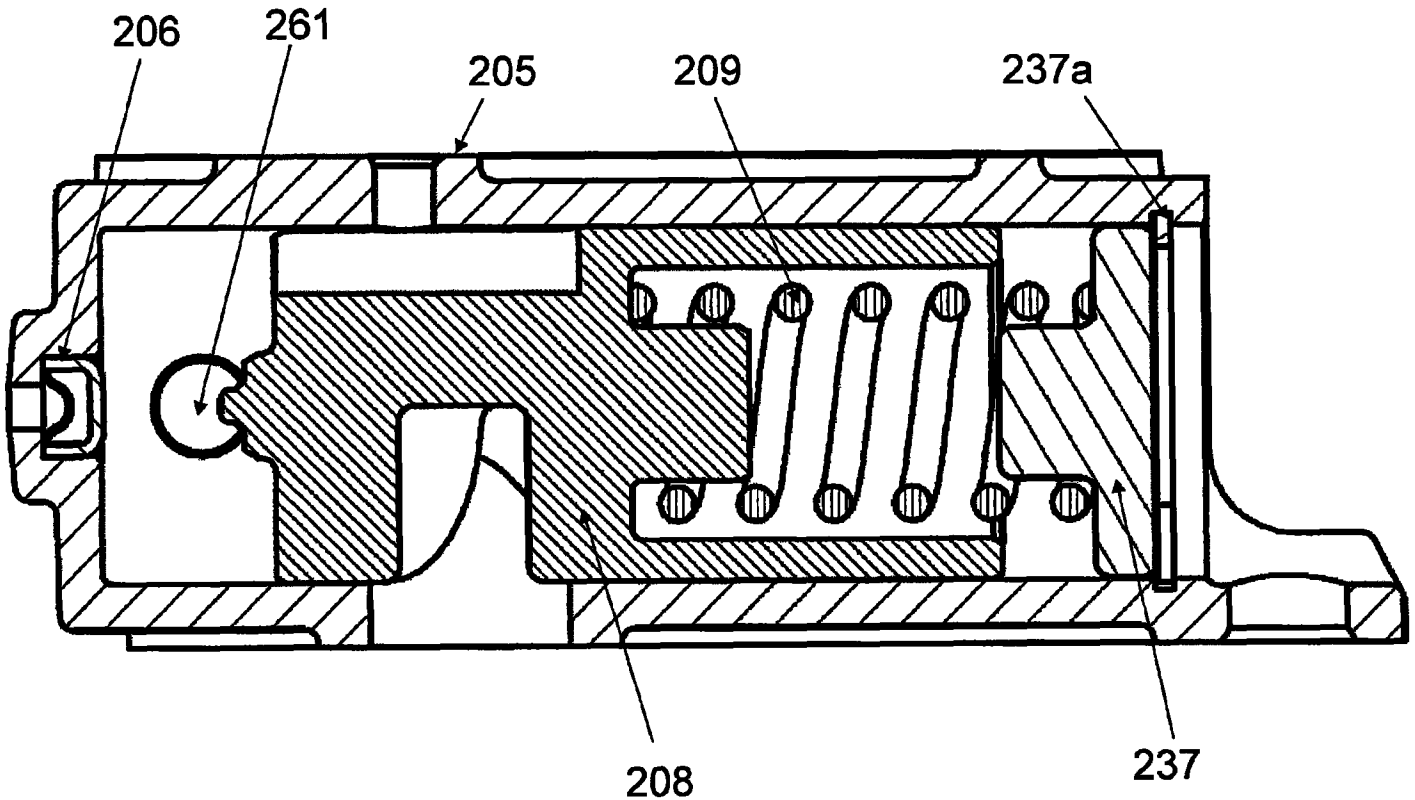
FIG. 14*c* is a cross sectional side view of the firing mechanism housing of a second embodiment of the ignition train mechanism of the present invention.

Referring now to FIGS. 10*a* and 10*b* which include ignition train mechanism housing 201 and ignition train mechanism cover 201*a*, within the housing 201 is the firing mechanism housing 205, containing the firing pin 208, primer cup 206 and compression spring 209 (further illustrated in FIGS. 14*a*, 14*b*, and 14*c*). Housing 205 is pivotally attached to the base of said housing 201 through pivot pin 202 to rotate in an arc between the initial unarmed position (shown in FIG. 16) at stop post 235 and the final firing position (shown in FIG. 21) at stop post 230, where the firing pin 208 has impacted the primer, creating a spark, igniting the pellets, and igniting the flare.

Figure 11A:
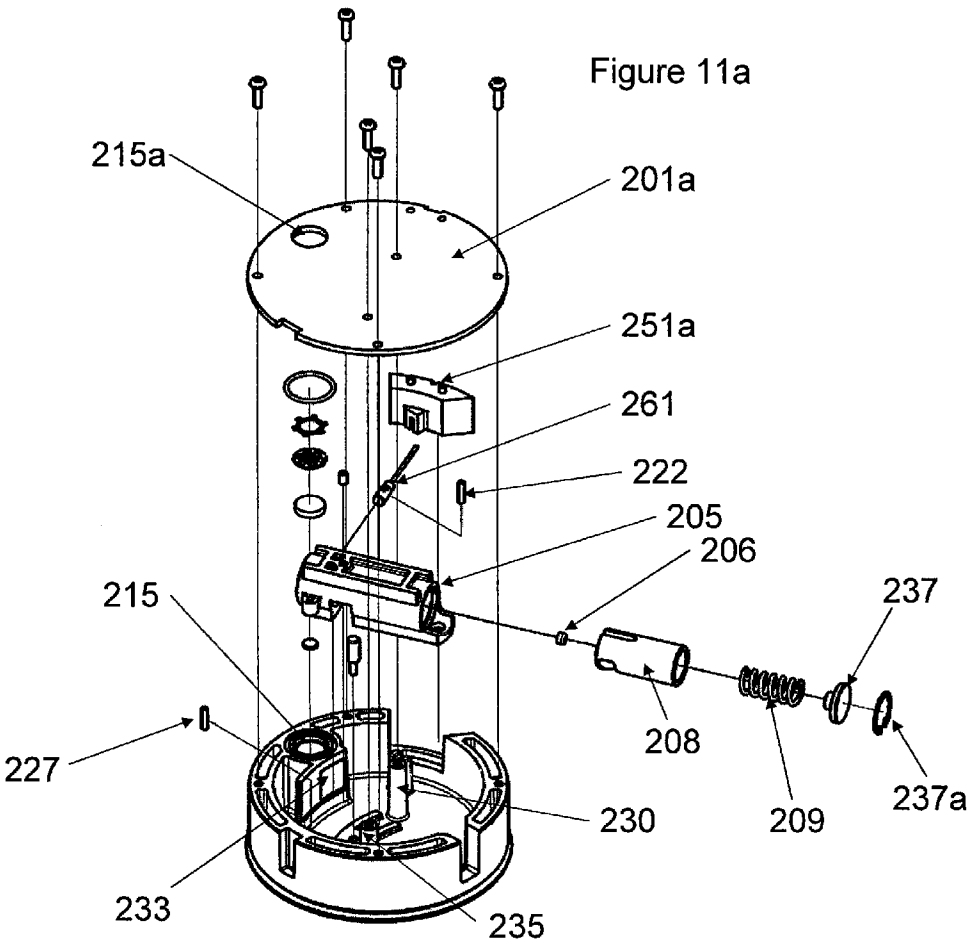
FIG. 11*a* is an exploded view of a second embodiment of the ignition train mechanism of the present invention.
Figure 11B:
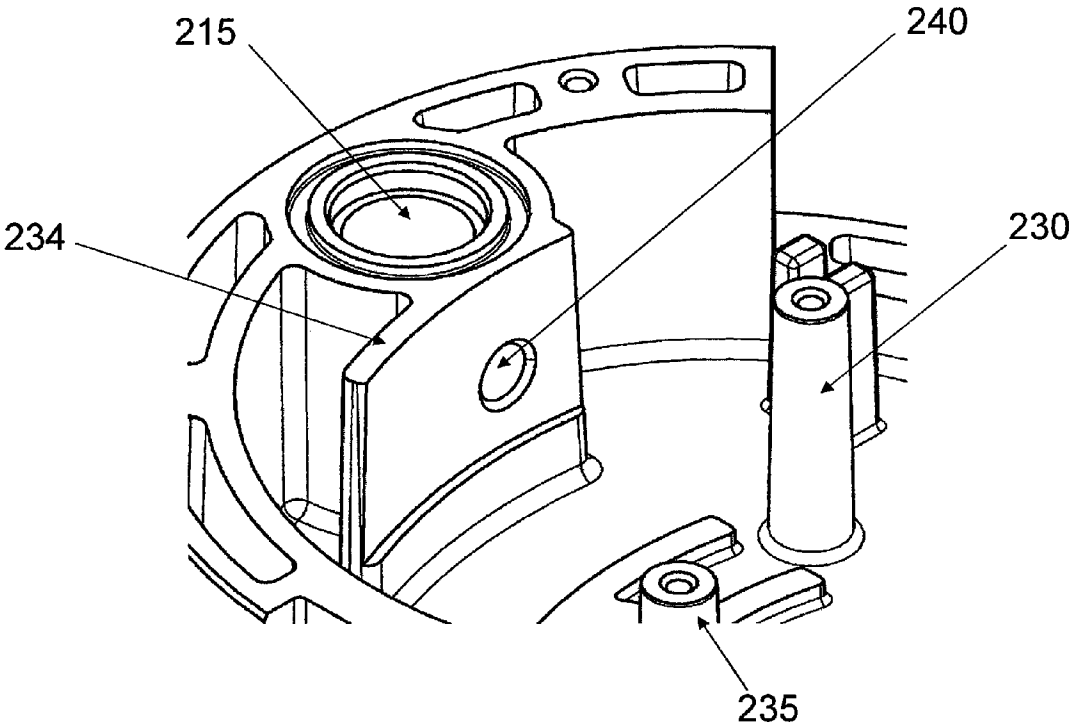
FIG. 11*b* is a prospective view of a portion of a second embodiment of the ignition train mechanism of the present invention showing the ignition canister and ignition opening.

FIG. 11*a* is an exploded view illustrating the operative components of the ignition train housing and their relative position and function. The Cover 201*a* in FIG. 11*a* is adjacent to the main candle compartment 120 of the illumination flare housing 100. The Cover 201*a* has at least 2 openings; a first opening aligned with the raceway channel 235 and a second opening aligned with the ignition canister 215. The ignition canister 215 is open such that the heat of combustion may pass through the cover opening 215*a* to ignite the main candle of the illumination flare via the ignition sequence described below.

Figure 12B:
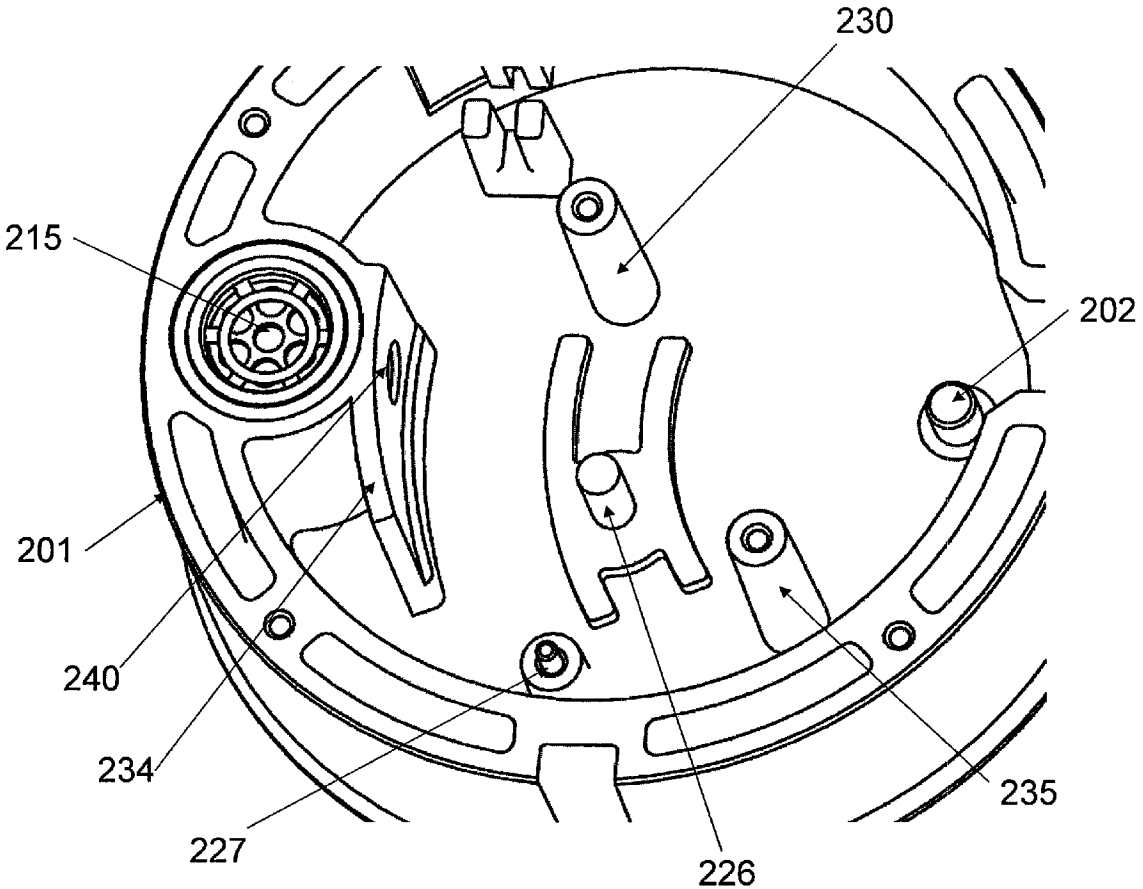

Referring now to FIGS. 10*a*, 12*a*, and 12*b*, the base of the ignition train mechanism housing 201 is shown. FIG. 10*a* includes the firing mechanism housing 205 which is attached at a first end to the ignition train housing 201 by pivot pin 202 and is movable about said pivot pin 202. The firing mechanism housing 205 has a shear pin fitting 245 positioned at a second end of the firing mechanism housing 205 (see also FIG. 14*b*). A shear pin 227 designed to break at a predetermined force is affixed to the base of the ignition mechanism housing 201 (See FIG. 12*a*). In the initial, unarmed, out-of-line position (see FIG. 16), shear pin 227 is engaged with shear pin fitting 245 which locks the firing mechanism housing 205 in the initial, out-of-line position. A first stop 235 is affixed to said base of said housing 201 and adjacent to said firing mechanism housing 205 in its initial, out-of-line position and prevents the firing mechanism housing 205 from traveling past the initial, out-of-line position.

Still referring to FIG. 10*a*, the firing mechanism housing 205 has a lanyard opening 260 positioned at a second end of the firing mechanism housing 205 opposite said pivot pin 202 (see also FIGS. 14*a* and 14*b*). A lanyard fitting 261 intersects the lanyard opening 260 such that a portion of the lanyard fitting 261 is inside the firing mechanism housing 205 to serve as a mechanical block as described below. The lanyard fitting 261 is secured in position by a lanyard shear pin 222 that intersects the firing mechanism housing 205 and the lanyard fitting 261. The lanyard cable 220 is attached to the lanyard fitting 261. The lanyard shear pin 222 is designed to break at a predetermined force. The break forces for the shear pins 222 and 227 are developed based on the forces to actuate the firing pin 208 using the cam follower pin 226 and compression spring 209 as described in more detail in the following sections. For example, the lanyard shear pin 222 is designed to break when the parachute is fully deployed and has descended to an altitude where the flare should be illuminated.

When the parachute is deployed and the risers are fully extended, the tension on the risers puts a tension on the lanyard cable 220 and on the shear pin 222. Likewise, there is tension on the shear pin 227. Shear pin 227 is designed to break with less force than lanyard shear pin 222; therefore, when the parachute is deployed, shear pin 227 breaks first and the firing mechanism housing 205 is pulled from the initial, out-of-line position towards the final, in-line position (see FIG. 21) by the lanyard cable 220. A second stop 230 is affixed to said base of said housing 201 and adjacent to said firing mechanism housing 205 in its final, in-line position and prevents the firing mechanism housing 205 from traveling past the final, in-line position. The second stop 230 causes the riser tension to increase to a force sufficient to break shear pin 222 while the firing pin 208 and primer cup 206 are in-line with the ignition canister 215.

Still referring to FIGS. 10*a*, 12*a*, and 12*b*, the ignition canister 215, which contains the ignition material to be ignited by the primer, is disposed within the housing 201. The pivot pin 202 is attached to the base of said housing 201 opposite the ignition canister 215. In some embodiments, a barrier wall 234 is adjacent ignition canister 215 and intermediate to said ignition canister 215 and said pivot pin 202. The second end of the firing mechanism housing 205 is adjacent to the barrier wall 234. Stops 235 and 230 are affixed to the base of said housing 201 at either end of the arc shaped path traveled by the firing mechanism housing 205. The second end of the firing mechanism housing 205 can pivot between stop posts 230 and 235 about said pivot pin 202 when the shear pin 227 is broken. The shear pin 227 provides added safety as it holds the firing mechanism in an unarmed, out-of-line position thereby significantly reducing the possibility of accidental firing of the mechanism.

Figure 11C:
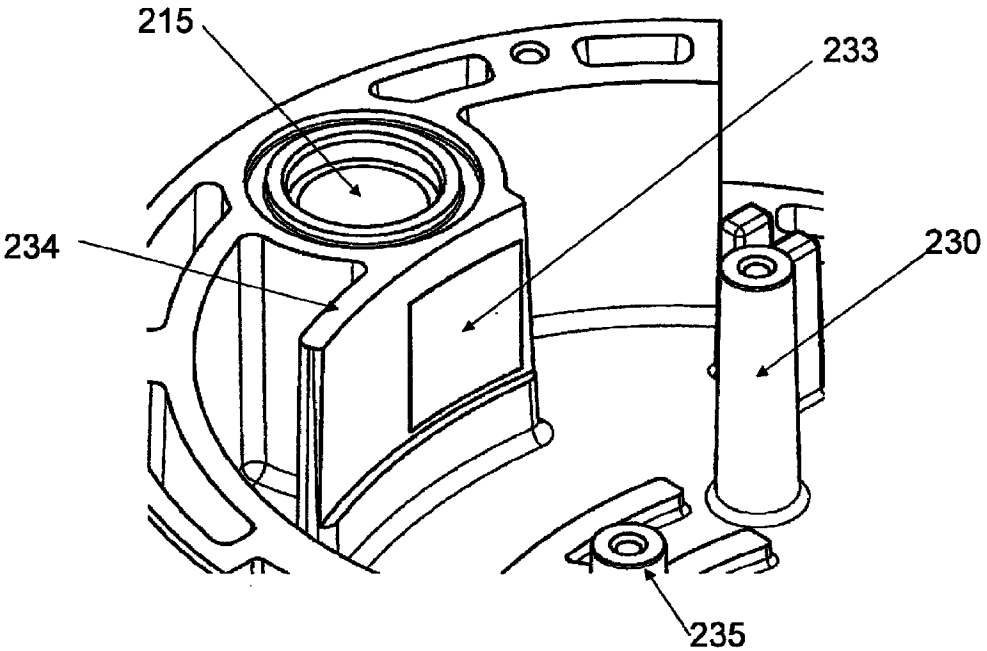
FIG. 11*c* is a prospective view of a portion of a second embodiment of the ignition train mechanism of the present invention showing the ignition canister, ignition opening. and aluminum foil tape as an electrostatic barrier.
Figure 16:
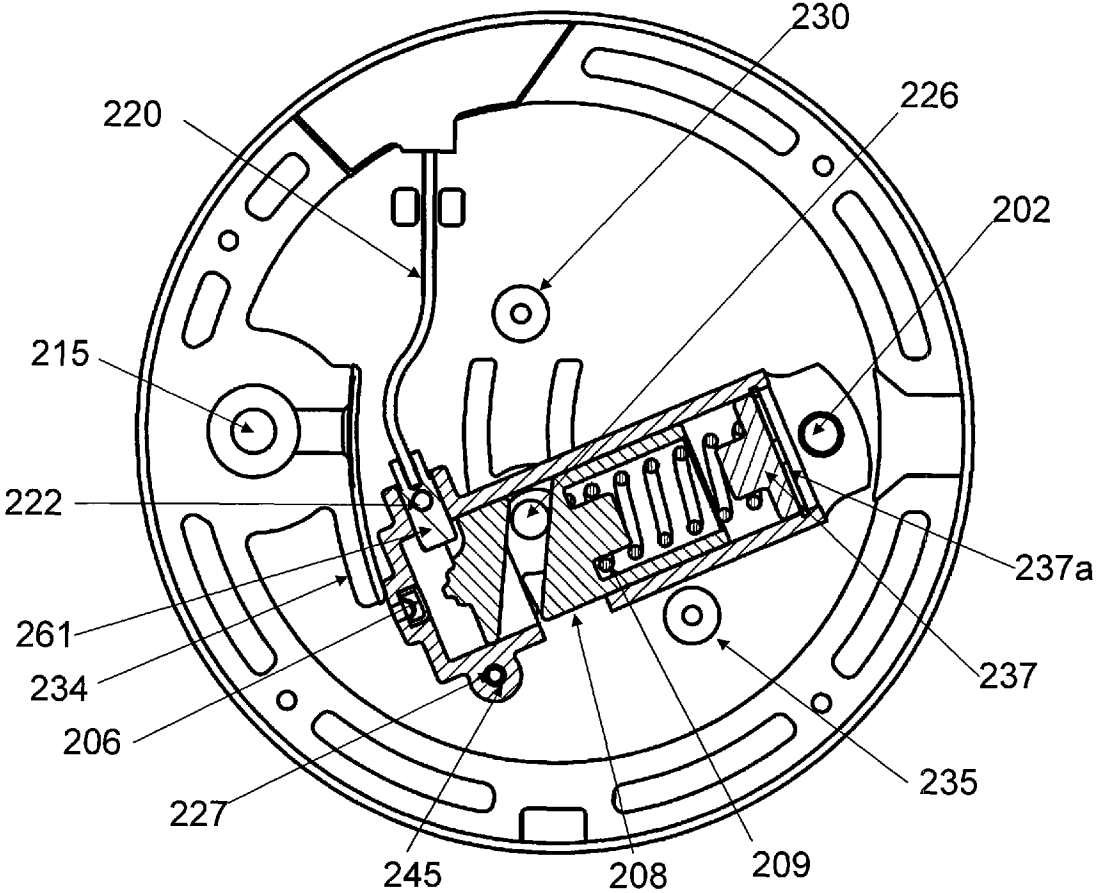
Figure 17:
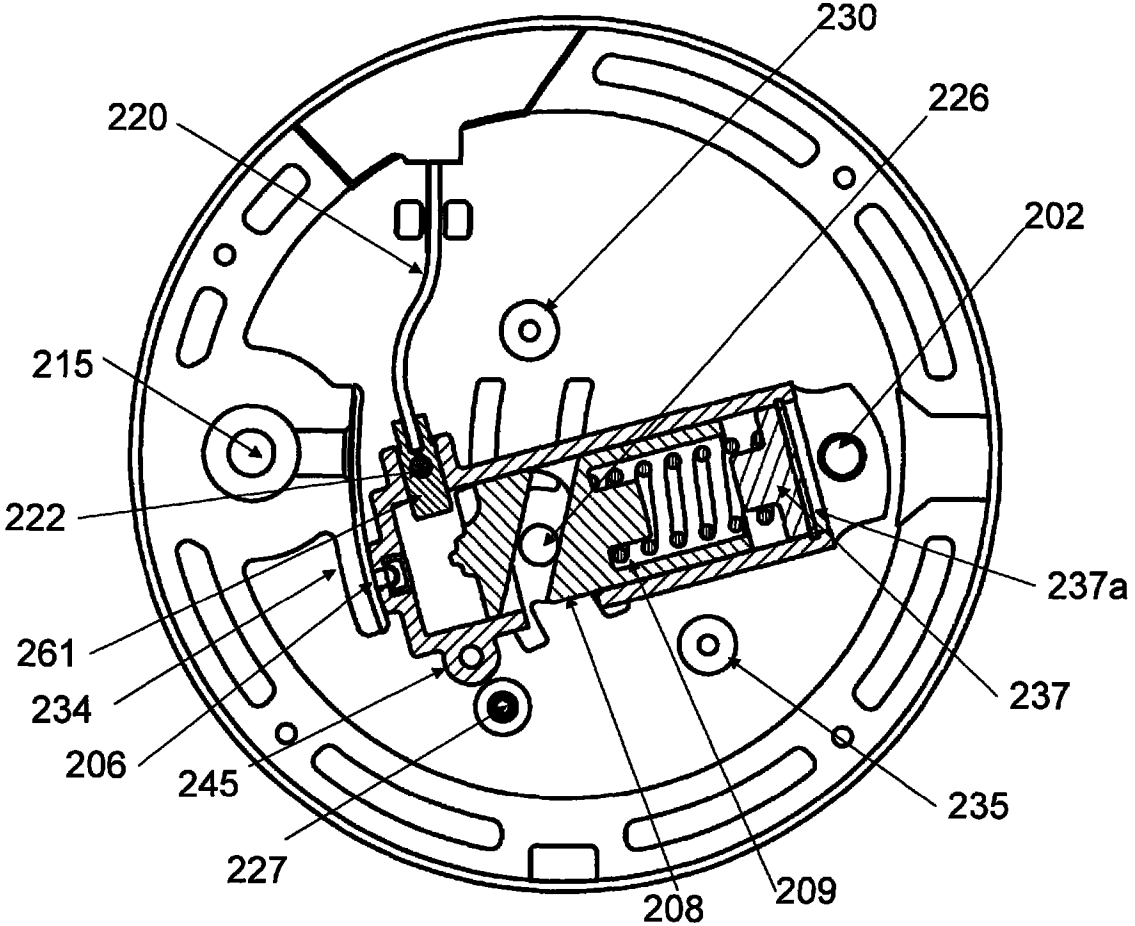

As shown in FIG. 16, the ignition train housing 201 includes a barrier wall 234 to block the direct path between the primer 206 and the ignition canister 215. The barrier wall 234 has an ignition opening 240 adjacent to the ignition canister 215 (see FIG. 11*b*). When the firing mechanism housing 205 is in its final, in-line position (see FIG. 21), the second end of the housing 205 and the primer cup 206 are adjacent to the ignition opening 240. As shown in FIG. 11*c*, in other embodiments, a thin electrostatic barrier aluminum foil tape 233 is placed over the opening 240 in the barrier wall 234 as a safety feature. In the event the ignition primer 206 is ignited unintentionally due to electrostatic discharge (ESD), the primer energy will not reach and ignite the pellets in the ignition canister 215. In the event the primer 206 is unintentionally ignited due to ESD, the energy must travel a longer path around the pivot end 202 of the ignition mechanism housing 205 before reaching the aluminum tape 233 covering the path to the ignition canister 215.

Figure 21:
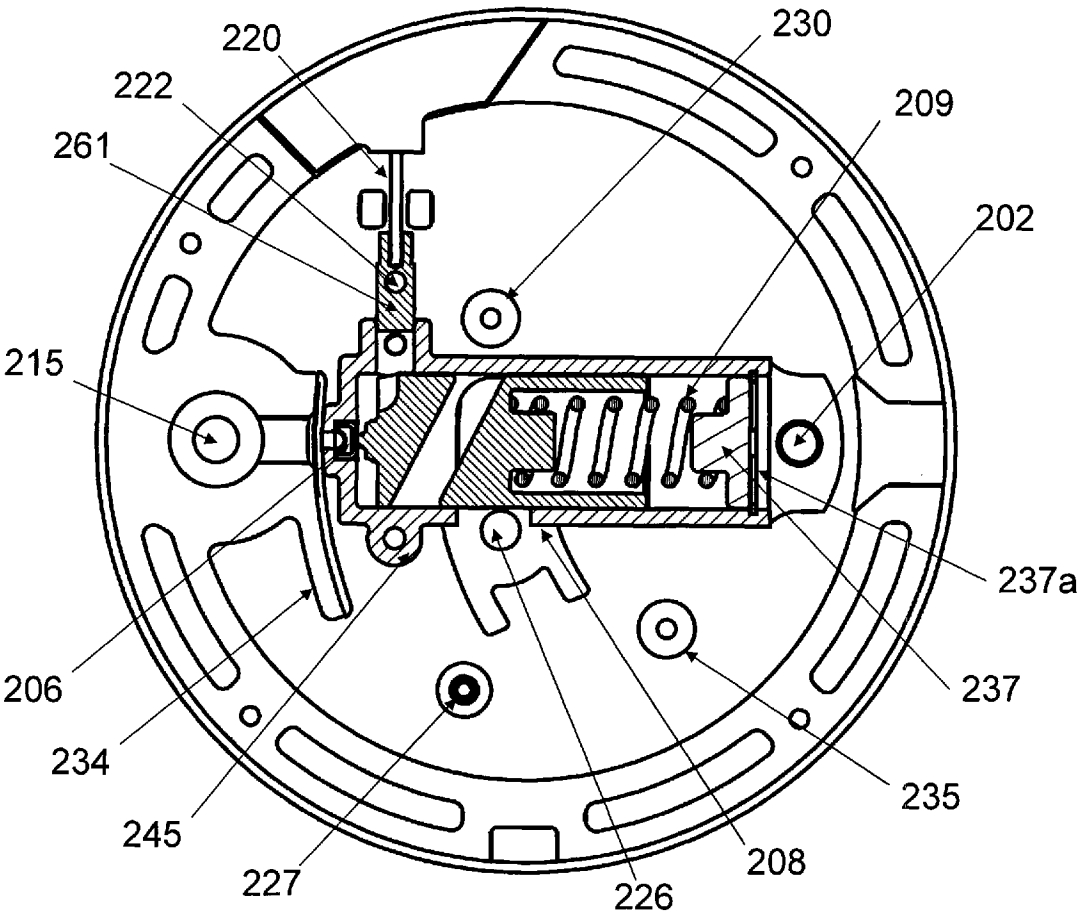

Referring now to FIG. 11*a*, the firing mechanism housing 205 contains the primer cup 206, the firing pin 208, the compression spring 209, washer 237, and retaining ring 237*a*. The firing pin 208 is slideably disposed inside and axially aligned with the firing mechanism housing 205. The firing pin 208 has a striking tip 208*a* at one end of the firing pin 208. The striking tip 208*a* is adjacent to the second end of the firing mechanism housing 205. The second end of the firing mechanism housing 205 has an primer opening 241 which is aligned with the ignition opening 240 in the barrier wall 234 when the firing mechanism housing 205 is in the final, in-line position (FIG. 21). The primer cup 206 is positioned in and affixed to the primer opening 241. The primer cup 206 is axially aligned with the striking tip 208*a* such that the striking tip 208*a* fits inside the primer cup 206 (FIGS. 14*b*, 14*c* and 21) and is capable of striking the center of the primer cup 206.

The primer cup 206 contains an ignition primer to create a spark when struck by the firing pin 208. The ignition primer can be any ignition primer composition commonly used with pyrotechnic flares, for example CCI Inc. No. 200 Rifle Primer. The primer cup 206 is aligned with the ignition opening 240 and the ignition canister 215 when the firing mechanism housing 205 is in the final, in-line position (FIG. 21). When the firing pin 208 strikes the primer cup 206, a spark is created igniting the ignition primer composition. The heat from the primer cup 206 is transferred through the ignition opening 240 to ignition canister 215. In embodiments including an electrostatic barrier, the electrostatic barrier 233 is destroyed or burned by the energy and heat from the primer 206.

The bottom portion of the ignition canister 215 contains ignition pellets which are ignited by the heat from the primer cup 206. The ignition pellets can be made of any composition of pyrotechnic material commonly used with pyrotechnic flares. For example $BKNO_3$ pellets which are primarily made of potassium nitrate. The top of the ignition canister 215 is open and connected to the main candle compartment 120 via opening 215*a* (FIGS. 10*b*, 10*c*, and 10*d*). The lower surface of the main candle compartment 120 contains an ignition compound which is ignited by the heat from the ignition pellets. The heat from the ignition canister 215 is transferred to the main candle compartment 120 and ignites the ignition compound. The ignition compound can be made of any composition of pyrotechnic material commonly used with pyrotechnic flares. The remainder of the main candle compartment contains the main candle flare composition. The heat from the ignition compound ignites the main candle composition of the flare. The main candle composition can be made of any composition of pyrotechnic material commonly used with pyrotechnic flares.

Referring now to FIGS. 11*a*, 14*b* and 14*c*, a compression spring 209 is disposed within the firing mechanism housing 205 adjacent to the first end of the firing mechanism housing 205. A washer 237 and retaining ring 237*a* are disposed intermediate to the spring 209 and the housing 205. The compression spring 209 is axially aligned and slideably engaged with the firing pin 208. The firing pin 208 has at least one spring stop 208*b* which contact the forward end of the spring 209 such that when the firing pin 208 moves rearwardly towards the pivot point at the first end of the firing mechanism housing 205, the spring 209 is compressed. The spring 209 is not preloaded, being compressed only after the ignition sequence is started, which provides for additional safety. As the firing pin 208 travels rearward inside the housing 205, the spring 209 is compressed against the washer 237, providing the energy to the firing pin 208 to ignite the primer 206 when the firing pin 208 is released.

Figure 13A:
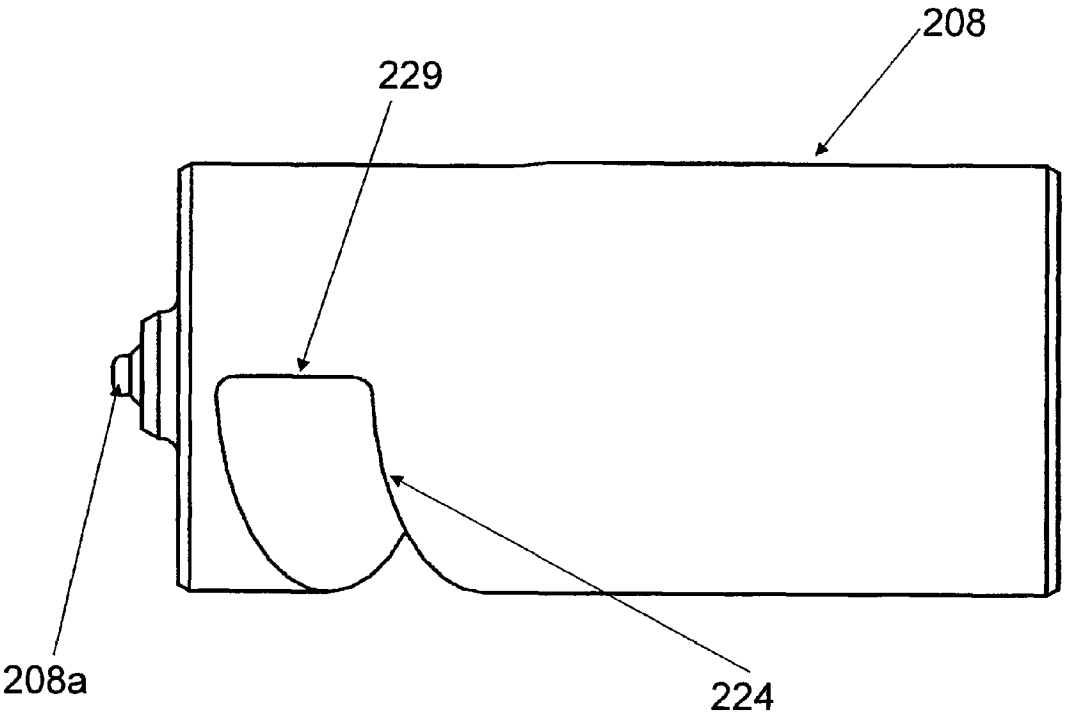
FIGS. 13*a*, 13*b*, 13*c*, and 13*d* are pictorial views of the firing pin of a second embodiment of the ignition train mechanism of the present invention.
Figure 13B:
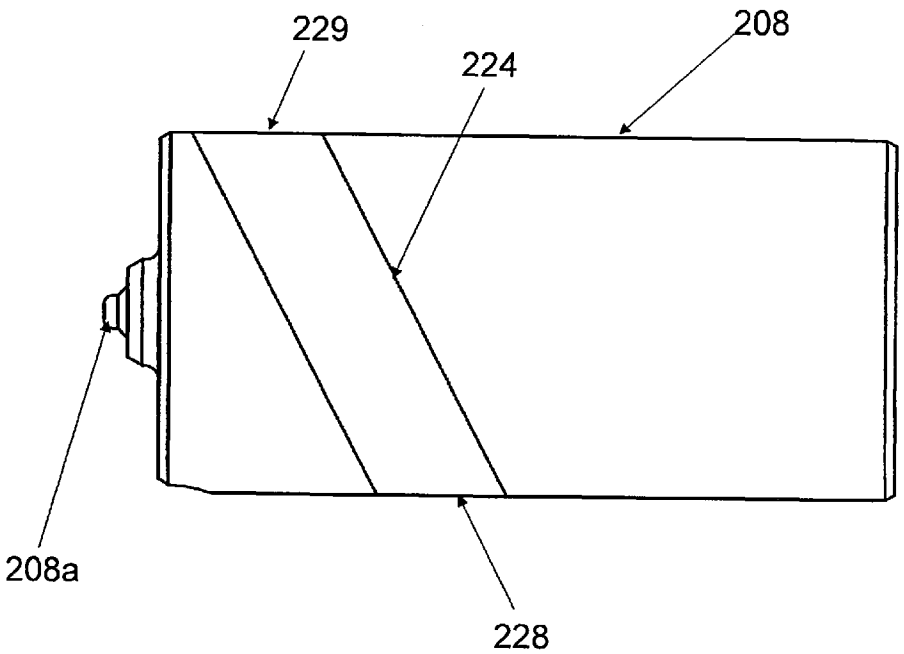
Figure 14D:
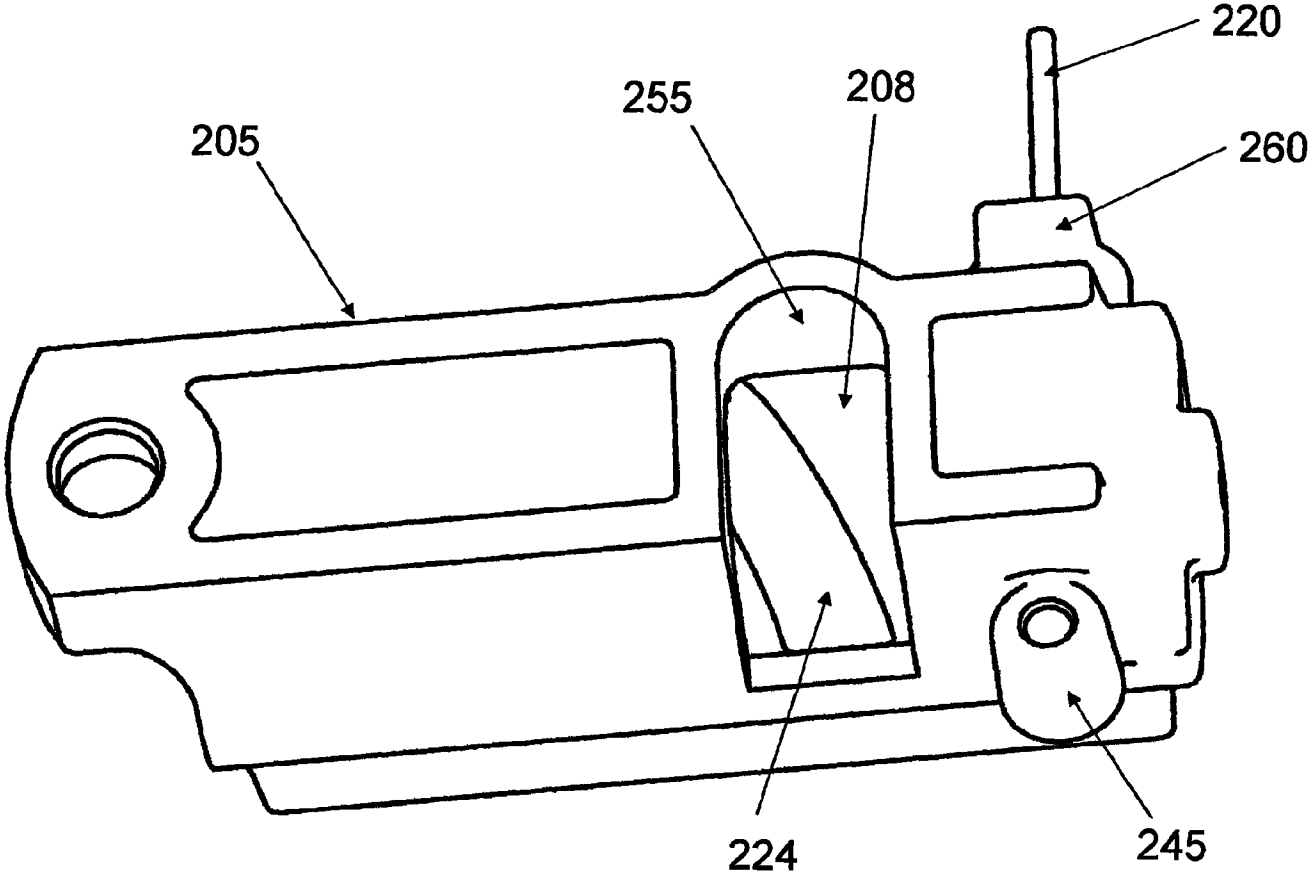
FIG. 14*d* is a bottom view of the firing mechanism housing of a second embodiment of the ignition train mechanism of the present invention.
Figure 15A:
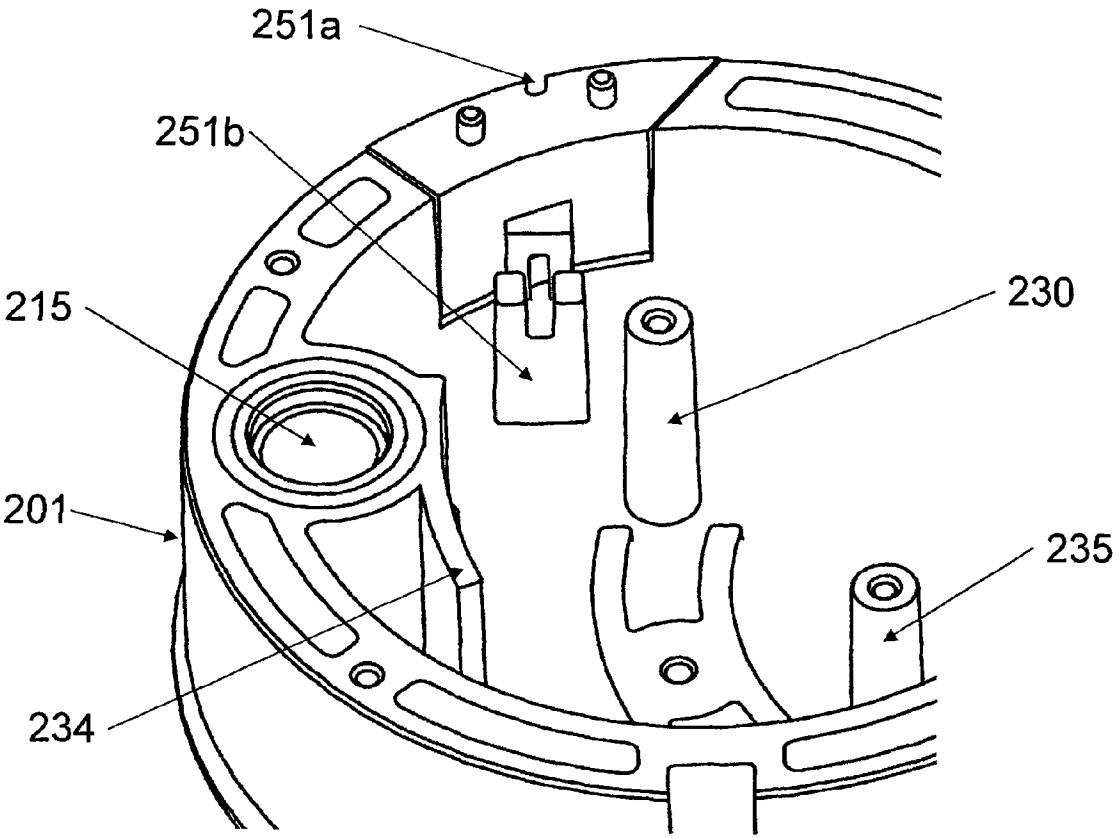
FIG. 15*a* is a partial view of the inside of the housing of a second embodiment of the ignition train mechanism of the present invention showing the lanyard cable guides.
Figure 15B:
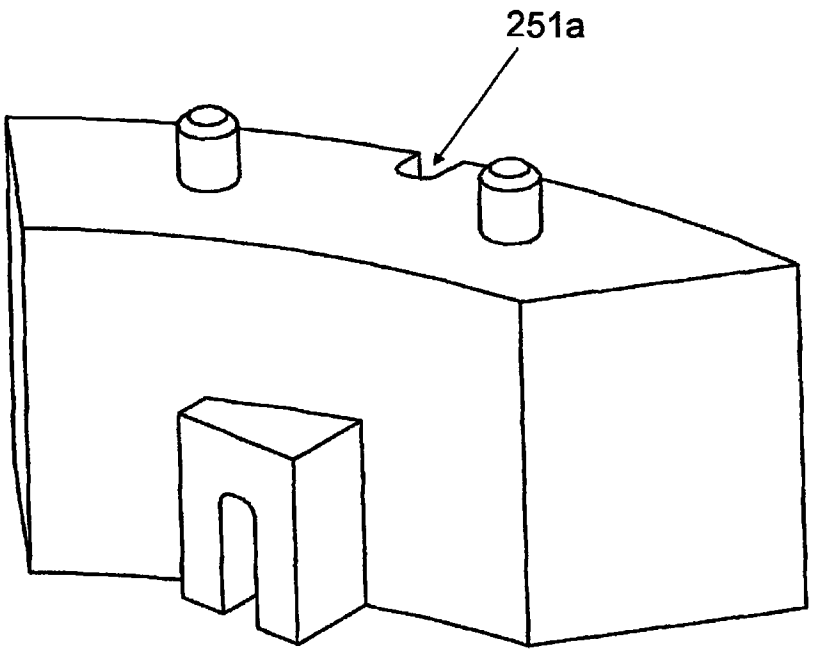
FIG. 15*b* is a view of the lanyard cable guide of a second embodiment of the ignition train mechanism of the present invention.

Referring now to FIGS. 13*a* and 13*b*, the bottom side of the firing pin 208 has a cam follower passage (slot) 224 which allows for rearward motion of the firing pin 208 and compression of the spring 209. The bottom side of the firing mechanism housing 205 has a cam follower opening 255 (FIG. 14*d*). When assembled, the cam follower passage 224 fits over the cam follower opening 255. The cam follower pin 226 is affixed to the base of the housing 201 (FIGS. 12*a* and 12*b*). When the assembled firing mechanism housing 205 is installed in the housing 201, the cam follower pin 226 is inserted into the cam follower opening 255 and cam follower passage 224 (FIG. 16). As shown in FIG. 16, the cam follower pin 226 is adjacent to the forward edge of the cam follower passage 228 when the firing mechanism housing 205 is in the initial, out-of-line position. The forward edge 228 is closer to the first end of the firing mechanism housing 205 than the rear edge 229. As the housing 205 is pulled by the lanyard cable 220 and rotates about the pivot pin 202, the cam follower passage 224 travels along the cam follower pin 226 from the forward edge 228 towards the rear edge of the cam follower surface 229 thereby forcing the firing pin to slide backwards within the housing 205 towards the first end of the firing mechanism housing 205. As the firing pin 208 slides rearward, the spring stops 208*b* contact the spring 209 and the spring 209 is compressed thereby cocking the firing pin. (FIGS. 16-21) At a certain position of the pivotal movement of the firing mechanism housing 205, the firing pin 208 slides off the cam follower pin 226 thereby releasing the firing pin 208 and the compressed spring 209. (FIG. 19). The energy stored in the spring 209 is transferred to the firing pin 208 which travels forward and strikes the primer in the primer cup 206 creating a spark to ignite the pellets in the ignition canister 215.

Referring now to FIG. 14*a*, in some embodiments an alignment pin 231 is disposed in alignment hole 231*a* in the top of the firing mechanism housing 205 and protrudes into the inside of the housing 205. Referring now to FIG. 13*d*, the firing pin 208 has an alignment slot 232 disposed longitudinally on the firing pin 208 which is at least as long as the travel distance of the firing pin 208 within the housing 205. The alignment pin 231 fits into the slot 232 when the firing pin 208 is disposed within the housing 205. The alignment pin 231 prevents the firing pin 208 from rotating within the housing 205 after the ignition train mechanism is actuated. This is important to keep the cam follower passage 224 correctly oriented so the cam follower pin 226 and the cam follower passage 224 are engaged at the correct position. This results in a more repeatable rearward travel distance by the firing pin 208 and compression of the spring 209.

Figure 13C:
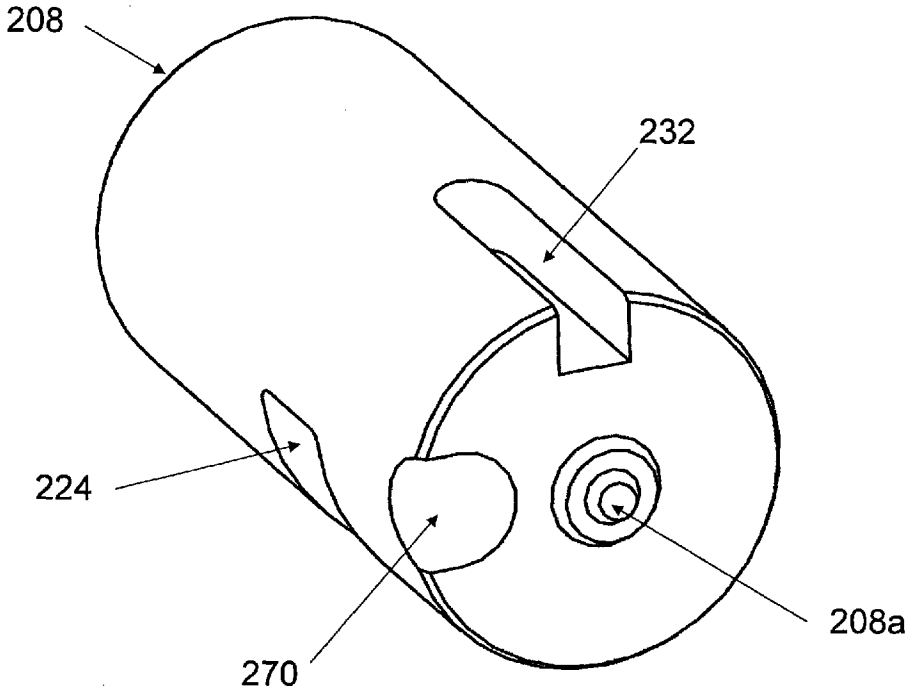
Figure 13D:
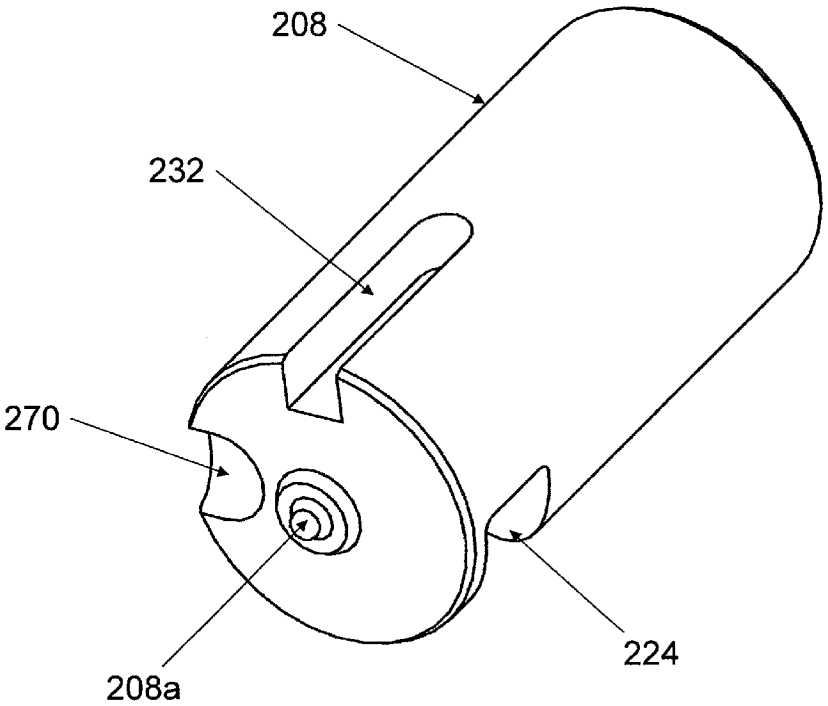

Referring now to FIG. 13*c*, in some embodiments the firing pin 208 has a locking recess 270 at the end of the firing pin with the striking tip 208*a* which provides an additional safety measure. The locking recess 270 is substantially aligned with the lanyard opening 260. The lanyard fitting 261 protrudes into the internal cavity of the firing mechanism housing 205 and fits into the locking recess 270 thereby acting as a mechanical block to prevent the firing pin 208 from striking the primer 206 until the parachute is deployed initiating the ignition train firing sequence. Once a predetermined amount of force is applied to the lanyard shear pin 222 when the firing mechanism housing 205 is in the final, in-line position, the lanyard shear pin 222 breaks and the lanyard fitting 261 is pulled from the lanyard opening 260 thereby removing the mechanical block leaving the firing pin 208 free to strike the primer 206 (FIGS. 20 and 21).

Figure 18:
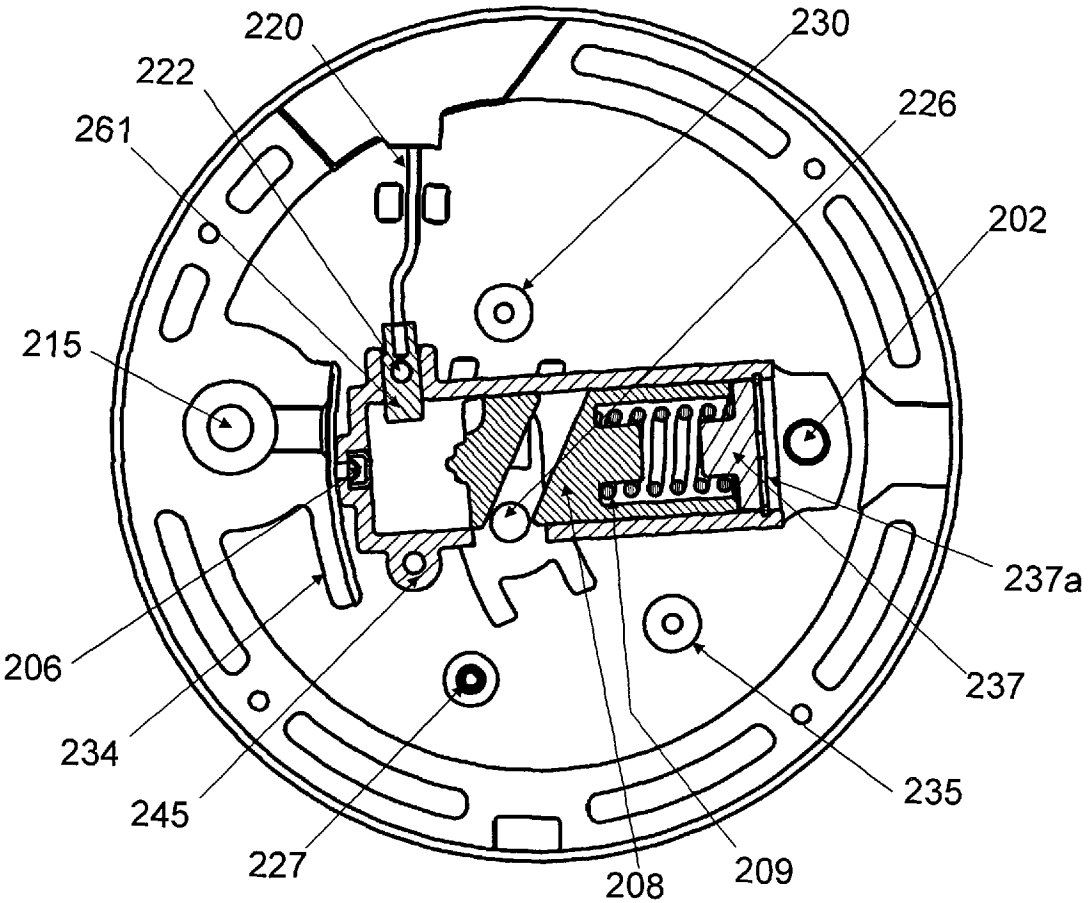
Figure 19:
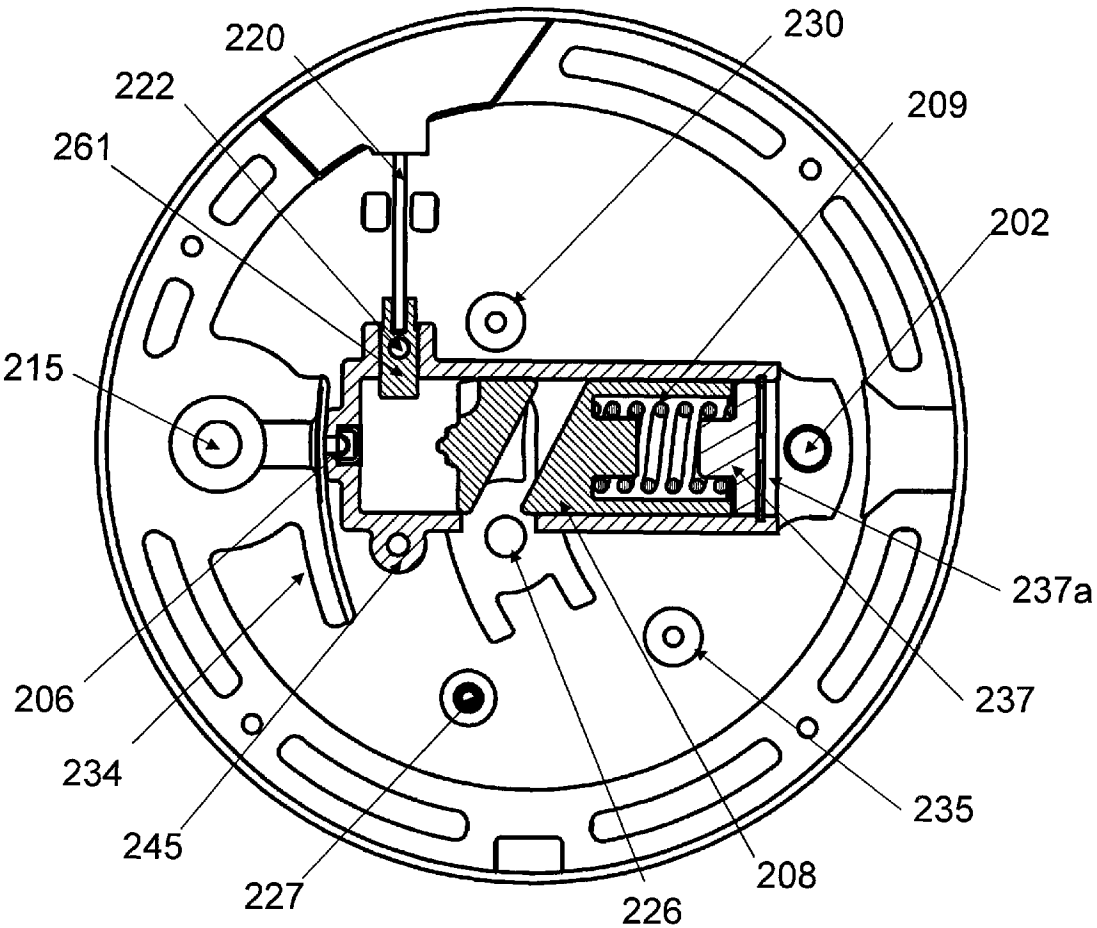

FIGS. 16 through 21 illustrate the components and articulation of the firing pin housing 205 from the initial, locked, unarmed position (out-of-line) to the final, firing position (in-line). This embodiment includes a spring actuated firing pin 208, wherein the spring 209 is loaded, or compressed, through the articulation of the housing 205 toward the ignition canister 215. The loading is enabled by the opening of the parachute attached to the flare housing 100 wherein fully extended risers put tension on the lanyard assembly 220 causing the shear pin 227 to shear and release the housing 205. As the housing 205 rotates about pivot point 202, the cam follower passage (slot) 224 follows the cam follower pin 226 in a relative rearward travel (toward pivot point 202) whereby spring 209 is compressed and firing pin 208 is retracted toward the ultimate firing position. FIG. 18 illustrates the further loading of the spring 209 whereby the firing pin 208 and primer 217 are approaching alignment with the ignition canister 215. Forward edge 228 of the cam follower passage 224 is now approaching the cam follower pin 226.

Figure 20:
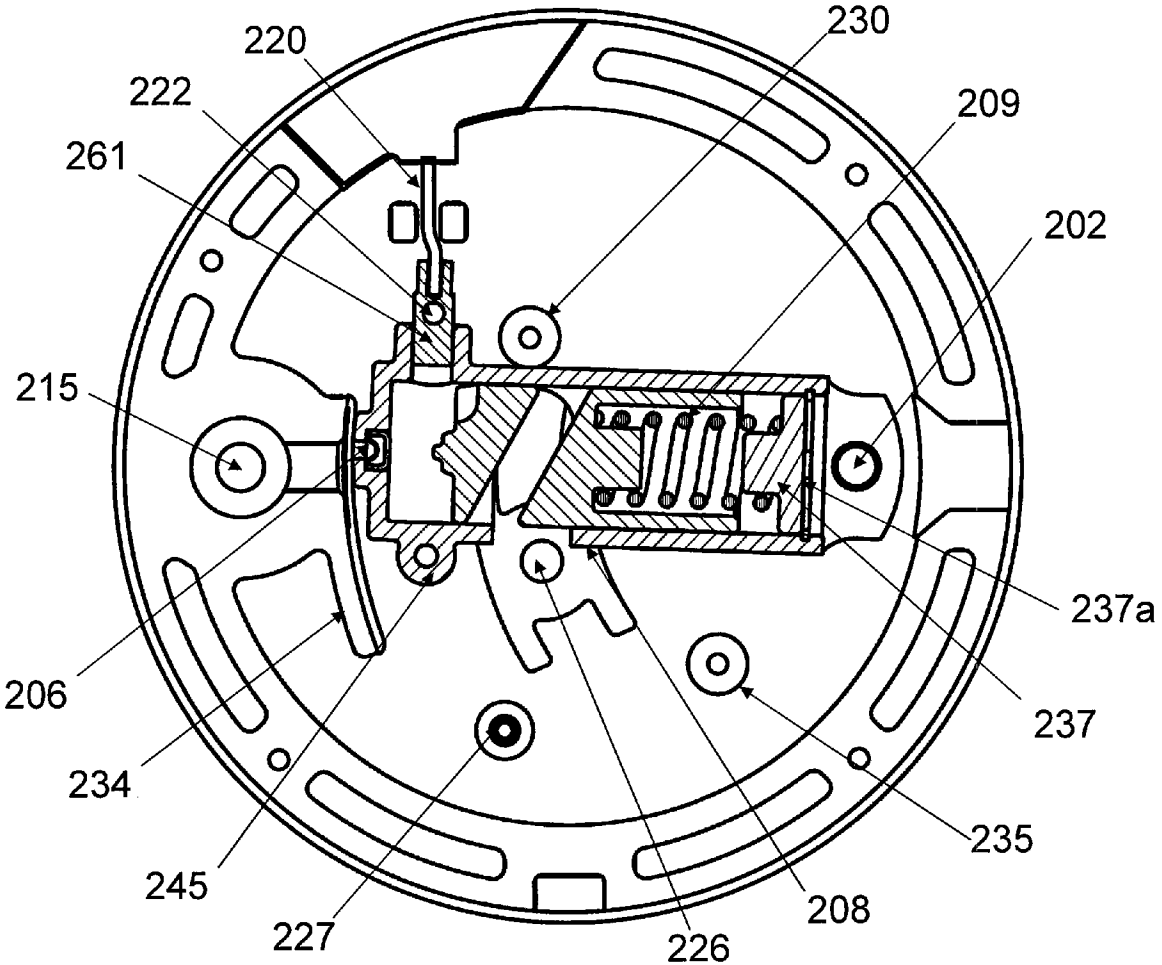

FIGS. 19 through 21 illustrate the sequence of actions as the cam follower pin 226 travels off of the cam follower passage 224 and "releases" the firing pin 208. The energy of the spring 209 causes the firing pin 208 to begin to travel toward the primer 206. At FIG. 20, the housing 205 has reached stop post 230 to limit the rotation of the housing 205. At this point the cam follower pin 226 has released the firing pin 208 allowing it to accelerate its movement toward the primer 206. Because of the tension on the lanyard cable assembly 220 from the parachute opening, the shear pin 222 is sheared and the lanyard assembly fitting 261 is pulled out of the firing pin housing 205 enabling the firing pin 208 to advance to strike the primer 206 and ignite the pellets in the ignition canister 215 as illustrated in FIG. 21. While a straight diagonal cam follower passage 224 is shown, it should be evident to those skilled in the art that other than straight line cam follower passages are within the scope of this invention. Curved cam follower passages can offer varying activation force profiles during the activation of the firing mechanism and may be beneficial to use depending on the force and rate of mechanism activation desired.

Thus, it is seen that the disclosed embodiments of two stage ignition train mechanisms for use with parachute suspended illumination flares of the present invention readily achieves the ends and advantages mentioned as well as those inherent therein. While certain preferred embodiments of the invention have been illustrated and described for the purposes of the present disclosure, numerous changes in the arrangement and construction of parts may be made by those skilled in the art, which changes are encompassed within the scope and spirit of the present invention as defined by the following claims.

What is claimed is:

1. A two stage ignition train mechanism for use with parachute suspended illumination flares comprising:

a housing positioned in the aft end of a parachute suspended illumination flare the housing having an ignition canister containing ignition pellets for igniting the illumination flare and a firing mechanism for igniting the ignition pellets, wherein the firing mechanism is affixed to said housing at a pivot point and rotatable about said pivot point between an unarmed position out of line with said canister to a firing position in-line with said canister; said mechanism comprising a mechanism housing, a firing pin, a spring and a primer cup, said primer cup attached to a movable end of said mechanism housing opposite said pivot point, said firing pin slideably disposed within said mechanism housing having a striking tip adjacent to and axially aligned with said primer cup, said spring intermediate to said firing pin and said pivot point and in contact with said firing pin;

a shear pin attached to said firing mechanism housing adjacent said unarmed position, said shear pin extending through a shear pin fitting affixed to said mechanism housing thereby locking said firing mechanism in the unarmed position;

a lanyard cable having a first end affixed to said mechanism housing and a second end affixed to a riser of a parachute to be ejected from said flare, whereby when said parachute is ejected from said flare, said shear pin breaks allowing rotational movement of said firing mechanism and said lanyard cable pulls said mechanism towards said firing position; and a means for arming and releasing the firing pin as the mechanism is rotated about the pivot point from the unarmed position to firing position thereby causing the firing pin to strike the primer, igniting the ignition pellets and the illumination flare.

2. The two stage ignition train mechanism of claim 1 further comprising:

a lanyard opening in said mechanism housing perpendicular to said mechanism housing axis for receiving a lanyard fitting, said first end of said lanyard cable attached to said lanyard fitting, said lanyard fitting protruding into said mechanism housing when inserted into said lanyard opening;

a lanyard shear pin with a pre-set shear force intersecting said lanyard fitting and said lanyard opening thereby holding said lanyard fitting in place; and said firing pin having a locking recess for receiving said lanyard fitting such that when said lanyard fitting is inserted in said lanyard opening it fits into said locking recess preventing axial travel of said firing pin beyond said lanyard fitting.

3. The two stage ignition train mechanism of claim 1 wherein said means for arming and releasing said firing pin comprises:

a cam follower passage disposed on the bottom of said firing pin having a forward edge adjacent to said lanyard cable and a rear edge adjacent to said shear pin fitting, said passage aligned with a cam follower opening in said mechanism housing, said passage substantially diagonal;

a cam follower pin affixed to said housing for receiving said cam follower passage whereby when said firing mechanism rotates from the unarmed position to the firing position, said cam follower pin slides along said cam follower passage and said firing pin slides axially toward said pivot point thereby compressing said spring and releasing said firing pin when said cam follower pin exits said passage causing said firing pin to travel axially towards and strike said primer cup igniting the flare.

4. The two stage ignition train mechanism of claim 3 further comprising:

an alignment pin intersecting said mechanism housing and protruding into said mechanism housing;

an alignment slot in said firing pin for receiving said alignment pin and preventing rotation of said firing pin when said alignment pin is inserted in said slot.

5. The two stage ignition train mechanism of claim 1 further comprising:

a barrier wall intermediate to said ignition canister and said firing mechanism to prevent accidental ignition of the ignition pellets, said barrier wall intermediate to said ignition canister and said firing mechanism, said barrier wall having an ignition opening axially aligned with the primer cup when the firing mechanism is in the firing position.

6. The two stage ignition train mechanism of claim 5 further comprising:

a thin electrostatic barrier affixed to the barrier wall covering said ignition opening to prevent accidental ignition of the ignition pellets.

7. The two stage ignition train mechanism of claim 6 wherein:

the electrostatic barrier is aluminum foil tape.

8. The two stage ignition train mechanism of claim 1 further comprising:

at least one lanyard guide affixed to the housing for directing said lanyard cable to said firing mechanism.

9. The two stage ignition train mechanism of claim 1 further comprising:

a first stop affixed to said ignition train mechanism housing adjacent to said initial position of said firing mechanism for preventing rotation of said firing mechanism beyond the initial position; and a second stop affixed to said ignition train mechanism housing adjacent to said final position of said firing mechanism for preventing rotation of said firing mechanism beyond the final position.

* * * * *